US006446614B1

(12) United States Patent
Matsuoka et al.

(10) Patent No.: US 6,446,614 B1
(45) Date of Patent: Sep. 10, 2002

(54) FUEL STORAGE APPARATUS AND ABNORMALITY DIAGNOSTIC METHOD

(75) Inventors: Takuya Matsuoka, Susono (JP); Mamoru Yoshioka, Susono (JP); Yoshihiko Hyoudou, Gotenba (JP); Naoya Takagi, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 105 days.

(21) Appl. No.: 09/704,786

(22) Filed: Nov. 3, 2000

(30) Foreign Application Priority Data

Nov. 4, 1999 (JP) ..... 11-314284
May 10, 2000 (JP) ..... 2000-137880
Nov. 2, 2000 (JP) ..... 2000-336203

(51) Int. Cl.[7] ..... F02M 37/04
(52) U.S. Cl. ..... 123/516; 123/519
(58) Field of Search ..... 123/516, 518, 123/519, 520

(56) References Cited

U.S. PATENT DOCUMENTS 5,925,817 A 7/1999 Kidokoro et al. ..... 73/40
6,240,908 B1 * 6/2001 Hydo et al. ..... 123/516
6,360,729 B1 * 3/2002 Ellsworth ..... 123/518
6,371,089 B1 * 4/2002 Matsuoka et al. ..... 123/519

* cited by examiner

*Primary Examiner*—Thomas N. Moulis
(74) *Attorney, Agent, or Firm*—Kenyon & Kenyon

(57) ABSTRACT

A fuel tank is divided into a fuel chamber and an air chamber by a bladder diaphragm. Under a condition that both the amount of intake air Ga and the engine revolution speed NE of an internal combustion engine are kept at constant values, a vapor concentration correction factor FGPG during a fuel injection duration TAU is calculated based on a change in the air-fuel ratio detected when gas is purged from the air chamber toward an intake passage of the engine. Based on the vapor concentration correction factor FGPG, it is determined whether there is fuel leakage from the fuel chamber to the air chamber. With this determination technique, a fluctuation in the air-fuel ratio is not caused by a situation where the engine is in a transitional state, during fuel leakage detection, so that the vapor concentration correction factor FGPG assumes a proper value corresponding to the vapor concentration in the air chamber. Therefore, a false determination regarding the presence/absence of fuel leakage from the fuel chamber to the air chamber is prevented.

29 Claims, 18 Drawing Sheets

BYPASS VSV CHANGE SIGNAL
AIR WINDOW SIDE
CANISTER SIDE

WITH RESET
FGPG0
+
FGPG
−
WITHOUT RESET

WITHOUT RESET
LEAN
AIR-FUEL RATIO
WITH RESET
RICH

WITHOUT RESET
FAFAV
1.0
WITH RESET
t1
t2
t3
t4
t

START
EXECUTING CONDITION MET ?
100
NO
YES
STORE FGPG1
160
SWITCH BYPASS VSV
162
164
T2 ELAPSED ?
NO
YES
200
LEAN A/F ?
YES
166
NO
RESET FGPG
NO
T5 ELAPSED ?
168
T3 ELAPSED ?
NO
202
YES
YES
READ FGPG 2
170
172
FUEL LEAKAGE ?
NO
176
174
YES
SET FUEL LEAK FLAG ON
SET FUEL LEAK FLAG OFF
178
SWITCH BYPASS VSV
T4 ELAPSED ?
NO
180
YES
FGPG←FGPG1
182
END

START
240
EXECUTING CONDITION MET ?
NO
YES
242
SWITCH BYPASS VSV
244
AND
SPD>A
Ga>B
epgr>C
?
NO
246
f←f+α
248
YES
D SEC. ELAPSED AFTER VEHICLE STOP ?
NO
YES
250
f←f+β
252
E SEC. ELAPSED AFTER PURGE STOP ?
NO
YES
254
f←f+γ
256
PURGE ACCUMULATION >f?
eafbpsg
NO
YES
258
READ FGPG
264
FGPG<H ?
NO
FGPG>J ?
NO
268
260
YES
YES
SET FUEL LEAK ABNORMALITY FLAG Fa ON
262
266
SET FUEL LEAK NORMALITY FLAG Fb ON
DETAIN DETERMINATION
RETURN

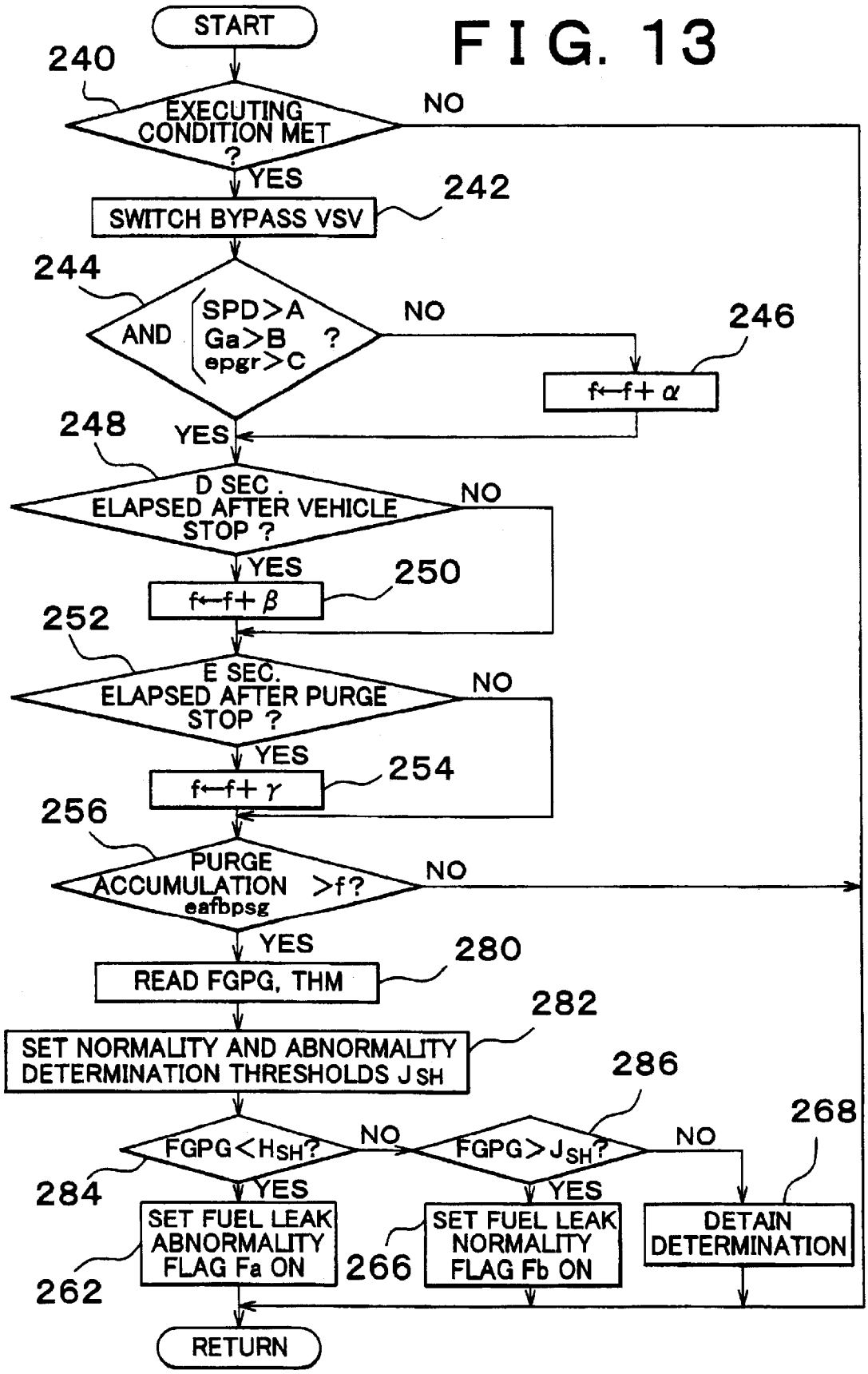
FIG. 13
START
240
EXECUTING CONDITION MET ?
NO
YES
242
SWITCH BYPASS VSV
244
AND
SPD>A
Ga>B
epgr>C
?
NO
246
f←f+α
248
YES
D SEC. ELAPSED AFTER VEHICLE STOP ?
NO
YES
250
f←f+β
252
E SEC. ELAPSED AFTER PURGE STOP ?
NO
YES
254
f←f+γ
256
PURGE ACCUMULATION >f?
eafbpsg
NO
YES
280
READ FGPG, THM
282
SET NORMALITY AND ABNORMALITY DETERMINATION THRESHOLDS JSH
286
268
FGPG<HSH?
NO
FGPG>JSH?
NO
284
YES
YES
SET FUEL LEAK ABNORMALITY FLAG Fa ON
262
266
SET FUEL LEAK NORMALITY FLAG Fb ON
DETAIN DETERMINATION
RETURN

FUEL STORAGE APPARATUS AND ABNORMALITY DIAGNOSTIC METHOD

INCORPORATION BY REFERENCE

The disclosures of Japanese Patent Application Nos. HEI 11-314284 filed on Nov. 4, 1999 and 2000-137880 filed on May 10, 2000, including the specifications, drawings and abstracts are incorporated herein by reference in their. entirety.

BACKGROUND OF THE INVENTION

1. Field of the Invention

The present invention relates to a fuel storage apparatus and an abnormality diagnostic method of the apparatus, and, more particularly, to a fuel storage apparatus that purges fuel vapor formed in a fuel tank that is divided into a fuel chamber and an air chamber by a partition membrane, and an abnormality diagnostic method of the apparatus.

2. Description of the Related Art

A known fuel vapor process apparatus that purges fuel vapor formed in a fuel tank into an intake passage to prevent emission of fuel vapor from the fuel tank into the atmosphere is disclosed in, for example, Japanese Patent Application Laid-Open No. HEI 10-184464. The fuel tank has a deformable partition membrane that separates an internal space of the fuel tank into a fuel chamber and an air chamber in a tightly closed fashion in order to reduce the occurrence of fuel vapor. The fuel vapor process apparatus has a canister for adsorbing fuel vapor from the fuel tank, and a purge control valve for controlling the open/close state between the canister and the intake passage. When the purge control valve of this apparatus is opened during operation of the internal combustion engine, negative pressure is introduced into the intake passage, so that air flows from the fuel tank toward the intake passage. In this case, together with flow of air, fuel adsorbed in the canister is purged toward the intake passage. Hence, the above-described fuel vapor process apparatus is able to supply fuel vapor formed in the fuel tank into the engine as a fuel without letting it out into, the atmosphere.

However, if the partition membrane of the fuel tank has a hole, or if the piping connected to the fuel chamber has a crack or a disconnected pipe, fuel may leak from the fuel chamber into the air chamber due to such an abnormality, so that there is a danger of emission of a portion of the fuel vapor into the atmosphere. Therefore, in the fuel tank divided into the fuel chamber and the air chamber by the partition membrane, it is necessary to diagnose whether there is fuel leakage from the fuel chamber to the air chamber. The proportion of fuel vapor to the amount of gas pre sent in the air chamber (hereinafter, referred to as "vapor concentration") is relatively low when there is no fuel leakage from the fuel chamber to the air chamber. The vapor concentration becomes relatively high if fuel is leaking from the fuel chamber to the air chamber. Therefore, as a technique for diagnosing whether there is fuel leakage from the fuel chamber to the air chamber, it is conceivable to detect the vapor concentration in the air chamber.

In order to secure good exhaust emissions from an internal combustion engine, it is necessary to keep the actual air-fuel ratio at a value near the theoretical air-fuel ratio. If fuel vapor formed in the fuel tank is supplied to the engine, the air-fuel ratio shifts to a fuel-rich side. In that case, therefore, the fuel injection duration set for the fuel injection valve of the engine is corrected in the decreasing direction by an amount of time corresponding to the amount of fuel vapor supplied to the engine. As the vapor concentration in the gas supplied to the engine increases, the rich tendency of the air-fuel ratio continues for an increased length of time, so that the amount of decrease correction of the fuel injection duration increases. Therefore, by detecting the air-fuel ratio after fuel vapor from the fuel tank is supplied to the engine, it becomes possible to detect the vapor concentration in the gas supplied from the fuel tank side to the engine.

Therefore, as a technique for detecting the vapor concentration in the air chamber, it is conceivable to interrupt purge of fuel adsorbed in the canister toward the intake passage, and to purge gas from the air chamber directly into the intake passage, bypassing the canister, and detect the air-fuel ratio afterwards. With the vapor concentration in the air chamber detected, it becomes possible to determine whether there is fuel leakage from the fuel chamber to the air chamber.

However, if the above-described fuel vapor process apparatus is used for a long time, the vapor concentration in the air chamber becomes high in some cases because the amount of fuel vapor that permeates through the partition membrane and flows into the air chamber increases. Furthermore, if the canister for adsorbing fuel is saturated, fuel adsorbed in the canister may flow back into the air chamber, thereby increasing the vapor concentration. Still further, in a construction in which the vapor concentration is detected based on the air-fuel ratio as described above, when the engine is in a transitional state, the air-fuel ratio considerably fluctuates, so that it becomes impossible to accurately detect the vapor concentration in the air chamber.

Therefore, if under the above-described condition, it is determined whether there is fuel leakage from the fuel chamber to the air chamber based on the vapor concentration in the air chamber as described above, there is a possibility of false determination that there is fuel leakage from the fuel chamber to the air chamber when there is actually no fuel leakage from the fuel chamber to the air chamber caused by an abnormality in the system, such as a hole in the partition membrane, a disconnected pipe, etc.

SUMMARY OF THE INVENTION

Accordingly, it is an object of the invention to provide a fuel storage apparatus capable of preventing a false determination regarding the presence/absence of fuel leakage from a fuel chamber to an air chamber in a fuel tank.

In accordance with a first aspect of the invention, a fuel storage apparatus includes a fuel tank divided into a fuel chamber and an air chamber by a partition membrane, concentration detecting means for detecting a fuel vapor concentration in the air chamber based on a change in an air-fuel ratio occurring when gas is purged from the air chamber toward an intake passage of an internal combustion engine, and fuel leakage determining means for determining whether there is a fuel leakage from the fuel chamber to the air chamber based on a result of detection by the concentration detecting means. It is determined by the fuel leakage determining means whether there is a fuel leakage from the fuel chamber to the air chamber, while a predetermined operational state of the internal combustion engine is maintained.

In this aspect, the determination by the fuel leakage determining means as to whether there is fuel leakage from the fuel chamber to the air chamber is performed under a condition that the predetermined operational state of the engine is maintained. That is, if the engine is in a transitional state, the determination regarding the presence/absence of fuel leakage is not performed. Therefore, at the time of determination regarding the presence/absence of fuel leakage from the fuel chamber to the air chamber, no fluctuation in the air-fuel ratio is caused by the situation where the engine is in the transitional state, so that it becomes possible to accurately detect the fuel vapor concentration in the air chamber. Hence, according to the invention, it is possible to prevent a false determination regarding the presence/absence of fuel leakage from the fuel chamber to the air chamber.

In accordance with a second aspect of the invention, a fuel storage apparatus includes a fuel tank divided into a fuel chamber and an air chamber by a partition membrane, concentration detecting means for detecting a fuel vapor concentration in the air chamber based on a change in an air-fuel ratio occurring when gas is, purged from the air chamber toward an intake passage of an internal combustion engine, and fuel leakage determining means for determining whether there is a fuel leakage from the fuel chamber to the air chamber based on a result of detection by the concentration detecting means. When the internal combustion engine is in a transitional state, determination by the fuel leakage determining means as to whether there is a fuel leakage from the fuel chamber to the air chamber is prevented.

In this aspect, when the engine is in the transitional state, the determination by the fuel leakage determining means whether there is fuel leakage from the fuel chamber to the air chamber is prohibited. Therefore, according to the invention, it is impossible to prevent a false determination regarding the presence/absence of fuel leakage from the fuel chamber to the air chamber attributed to the situation where the engine is in the transitional state.

In accordance with a third aspect of the invention, a fuel storage apparatus includes a fuel tank divided into a fuel chamber and an air chamber by a partition membrane, concentration detecting means for detecting a fuel vapor concentration in the air chamber based on a change in an air-fuel ratio occurring when gas is purged from the air chamber toward an intake passage of an internal combustion engine, and fuel leakage determining means for determining whether there is a fuel leakage from the fuel chamber to the air chamber based on a result of detection by the concentration detecting means. The fuel leakage determining means determines whether there is a fuel leakage from the fuel chamber to the air chamber based on the fuel vapor concentration in the air chamber detected by the concentration detecting means after gas is discharged out of the air chamber.

In this aspect, fuel vapor may flow from the fuel chamber into the air chamber, permeating through the partition membrane, in some cases. If in such a case, the determination regarding the presence/absence of fuel leakage from the fuel chamber to the air chamber is performed, there is a danger that it may be falsely determined that there is fuel leakage from the fuel chamber to the air chamber caused by fuel permeation or the like when no fuel leakage is actually caused by an abnormality in a system that includes the partition membrane and the like.

When there is fuel leakage from the fuel chamber to the air chamber caused by an abnormality in the system, the fuel vapor concentration in the air chamber will become high again within a short time after gas is discharged out of the air chamber. In contrast, when fuel is flowing from the fuel chamber into the air chamber merely due to permeation through the partition membrane or the like, the fuel vapor in the air chamber will not become high within a short time after gas is discharged out of the air chamber. Therefore, in this aspect, the determination by the fuel leakage determining means as to whether there is fuel leakage is performed based on the vapor concentration in the air chamber detected after gas is discharged out of the air chamber. The vapor concentration in the air chamber after gas is discharged out of the air chamber is not affected by fuel that permeates through the partition membrane, or the like, but assumes a value corresponding to the presence or absence of fuel leakage from the fuel chamber to the air chamber caused by an abnormality in the system. Therefore, in this aspect, it is possible to prevent a false determination regarding the presence/absence of fuel leakage from the fuel chamber to the air chamber even when fuel is flowing from the fuel chamber into the air chamber, permeating through the partition membrane.

In the aforementioned aspects, the "fuel leakage from the fuel chamber to the air chamber" refers to leakage of fuel from the fuel chamber to the air chamber caused by an abnormality in the system, such as a hole formed in the partition membrane, a crack formed in the piping connected to the fuel chamber, a disconnected pipe in the piping, etc.

As the outside temperature increases, or as the vehicle speed decreases, the temperature of the fuel tank becomes more likely to rise, so that fuel vapor becomes more likely to be formed in the fuel tank. Furthermore, with increases in the duration during which the vehicle is stopped, or with increases in the duration during which the purge from the air chamber toward the intake passage is stopped, the amount of fuel evaporating from the fuel chamber increases. In this respect, the amount of fuel that flows from the fuel chamber into the air chamber due to a factor other than the fuel leakage caused by an abnormality in the system, for example, permeation through the partition membrane or the like, fluctuates in accordance with the conditions of the fuel tanks, the vehicle, etc.

When it is considered that the vapor concentration in the air chamber has become high due to permeation through the partition membrane or the like, there is a danger of a false determination that there is fuel leakage from the fuel chamber to the air chamber if the duration of discharge of gas out of the air chamber is not long, that is, the amount of gas discharged out of the air chamber is not great, so that the air chamber still contains an amount of fuel attributed to permeation through the partition membrane or the like. Conversely, when it is considered that the fuel chamber in the air chamber has become low, fuel in the air chamber attributed to permeation through the partition membrane or the like is quickly discharged even if the duration of discharge of gas out of the air chamber is short, that is, if the amount of gas discharged out of the air chamber is small. Therefore, based on the fuel vapor concentration in the air chamber afterwards, it becomes possible to accurately determine whether there is fuel leakage from the fuel chamber to the air chamber caused by an abnormality in the system.

In the aforementioned aspect, the fuel storage apparatus may further include concentration increase degree detecting means for detecting a degree of increase in the fuel vapor concentration in the air chamber caused by a factor other than the fuel leakage from the fuel chamber to the air chamber. The fuel leakage determining means determines whether there is a fuel leakage from the fuel chamber to the air chamber based on the fuel vapor concentration in the air chamber detected by the concentration detecting means after an amount of time corresponding to the degree of increase detected by the concentration increase degree detecting means elapses following a start of discharge of gas out of the air chamber.

Furthermore, in this aspect, the fuel storage apparatus may further include concentration increase degree detecting means for detecting a degree of increase in the fuel vapor concentration in the air chamber caused by a factor other than the fuel leakage from the fuel chamber to the air chamber, wherein the fuel leakage determining means determines whether there is a fuel leakage from the fuel chamber to the air chamber based on the fuel vapor concentration in the air chamber detected by the concentration detecting means after an amount of gas discharged out of the air chamber after a start of discharge of gas out of the air chamber reaches an amount corresponding to the degree of increase detected by the concentration increase degree detecting means.

As the outside air temperature increases, the temperature of the fuel tank becomes more likely to increase, so that fuel vapor becomes more likely to be formed in the fuel tank, as mentioned above. Therefore, even where there is no fuel leakage caused by an abnormality in the system, the amount of fuel flowing from the fuel chamber into the air. chamber permeating through the partition membrane increases and the vapor concentration in the air chamber increases with increases in the outside temperature.

Therefore, in the aspect mentioned above, the concentration increase degree detecting means may detect the degree of increase in the fuel vapor concentration in the air chamber caused by the factor other than the fuel leakage from the fuel chamber to the air chamber, based on an outside air temperature.

In this aspect, the fuel storage apparatus may further include fuel injection increasing means for increasing an amount of fuel injected into the internal combustion engine when purge of gas from the air chamber to the intake passage is started. This construction is effective in avoiding remarkable fluctuations in the air-fuel ratio during execution of determination regarding a membrane hole in the partition membrane.

In this aspect, the fuel vapor concentration in the air chamber is normally low. Therefore, if gas is purged from the air chamber toward the intake passage, the air-fuel ratio is highly likely to shift to the fuel lean side, so that deterioration of exhaust emissions becomes highly likely. Therefore, when the purge of gas from the air chamber toward the intake passage is started, it is appropriate to correct the amount of fuel injected beforehand so that the air-fuel ratio is kept at a theoretical air-fuel ratio after the start of the purge.

In this aspect, when the purge of gas from the air chamber to the intake passage is started, the amount of fuel injected into the engine is increased. Therefore, according, to the invention, it is possible to avoid remarkable. Fluctuations in the air-fuel ratio when gas is purged from the air chamber toward the intake passage under a condition that the vapor concentration is low.

In this case, the fuel injection increasing means may increase the amount of fuel injected, if the air-fuel ratio is on a lean side after the purge of gas from the air chamber to the intake passage is started.

Furthermore, in the aforementioned aspect, the fuel injection increasing means may increase the amount of fuel injected, by reducing an amount of decrease correction of the amount of fuel injected.

In accordance with a fourth aspect of the invention, a fuel storage apparatus includes a fuel tank divided into a fuel chamber and an air chamber by a partition membrane, concentration detecting means for detecting a fuel vapor concentration in the air chamber based on a change in an air-fuel ratio occurring when gas is purged from the air chamber toward an intake passage of an internal combustion engine, and fuel leakage determining means for determining whether there is a fuel leakage from the fuel chamber to the air chamber based on a result of detection by the concentration detecting means. The fuel leakage determining means determines whether there is a fuel leakage from the fuel chamber to the air chamber, by comparing the fuel vapor concentration in the air chamber detected by the concentration detecting means with a threshold that is changed in accordance an outside air temperature.

In this aspect, the determination by the fuel leakage determining means as to whether there is fuel leakage from the fuel chamber to the air chamber is performed by comparing the vapor concentration in the air chamber with the threshold that is changed in accordance with the outside air temperature. As the outside air temperature increases, the temperature of the fuel tank becomes more likely to rise, so that fuel vapor becomes more likely to be formed in the fuel tank. Therefore, even where there is no fuel leakage caused by an abnormality in the system, the amount of fuel that flows from the fuel chamber into the air chamber permeating through the partition membrane increases and the vapor concentration in the air chamber increases with increases in the outside air temperature. However, in this aspect, when the vapor concentration in the air chamber becomes high due to a high outside air temperature, the above-described fuel storage apparatus changes the threshold for determination regarding fuel leakage. Therefore, it is possible to prevent a false determination regarding the presence/absence of fuel leakage from the fuel chamber to the air chamber.

In accordance with a fifth aspect of the invention, a fuel storage apparatus is provided which includes a fuel tank divided into a fuel chamber and an air chamber by a partition membrane, concentration detecting means for detecting a fuel vapor concentration in the air chamber based on a change in an air-fuel ratio occurring when gase is purged from the air chamber toward an intake passage of an internal combustion engine, fuel leakage determining means for determining whether there is a fuel leakage from the fuel chamber to the air chamber based on a result of detection by the concentration detecting means, and refueling detecting means for detecting whether fuel has been supplied to the fuel tank by refueling. In the fuel storage apparatus, when the refueling detecting means determines that the fuel has been supplied to the fuel tank by refueling, the fuel leakage determining means determines whether there is a fuel leakage from the fuel chamber to the air chamber, based on a fuel vapor concentration in the air chamber which is detected by the concentration detecting means after gas in the air chamber is discharged to the outside thereof.

In the above aspect of the invention, whether fuel has been supplied to the fuel tank by refueling is determined. When fuel was supplied to the fuel tank through refueling of the vehicle, a large amount of fuel vapor arises, and the fuel vapor concentration in the air chamber is increased even if no fuel leaks from the fuel chamber into the air chamber. Under this situation, therefore, it is not appropriate to determine whether fuel leaks from the fuel chamber into the air chamber.

According to the above aspect of the invention, the fuel leakage determining means determines whether there is a fuel leakage from the fuel chamber to the air chamber, based on a fuel vapor concentration in the air chamber which is detected after gas in the air chamber is discharged to the outside. The fuel vapor concentration in the air chamber measured after the gas in the air chamber is discharged to the outside is not greatly influenced by refueling, but depends upon the presence of fuel leakage from the fuel chamber into the air chamber due to an abnormality in the system. Accordingly, even in the case where fuel was supplied to the fuel tank by refueling, a false determination on the presence of fuel leakage from the fuel chamber into the air chamber can be prevented.

If the fuel tank is supplied with fuel, the fuel is accumulated in the fuel chamber, resulting in an increase in the volume of the fuel chamber and a reduction in the volume of the air chamber. Meanwhile, where a negative pressure is introduced into the air chamber, the pressure within the air chamber comes to be settled at a certain negative pressure in a relatively shorter time when the volume of the air chamber is smaller. Namely, the smaller the volume of the air chamber, the shorter the period of time required for the pressure in the air chamber to reach the certain negative pressure. Accordingly, whether fuel was supplied to the fuel tank or not (i.e., whether refueling took place or not) can be determined by calculating the time required for the pressure within the air chamber to reach the certain negative pressure after introduction of a negative pressure into the air chamber.

In one preferred form of the above aspect of the invention, the fuel storage apparatus may further include negative-pressure introducing means for introducing a negative pressure into the air chamber. In this case, the refueling determining means may determine whether fuel has been supplied to the fuel tank by refueling, based on a period of time that ranges from a point of time at which the negative pressure begins to be introduced into the air chamber, to a point of time at which the pressure within the air chamber reaches a predetermined negative pressure.

If a certain amount of gas in the fuel chamber is discharged, the fuel vapor concentration in the air chamber is not greatly influenced by fuel vapors caused by refueling, but becomes equal to a value that depends upon the presence of fuel leakage from the fuel chamber into the air chamber due to an abnormality in the system. Thus, even if fuel is supplied to the fuel tank by refueling, a false determination on the presence of fuel leakage from the fuel chamber into the air chamber can be prevented.

In another preferred form of the invention, when the refueling detecting means determines that the fuel has been supplied to the fuel tank by refueling, the fuel leakage determining means determines whether there is a fuel leakage from the fuel chamber to the air chamber, based on a fuel vapor concentration in the air chamber which is detected by the concentration detecting means after an accumulated value of discharge amounts of gas in the air chamber to the outside thereof reaches a predetermined value.

In order to purge the air chamber to a certain extent after refueling was conducted, the amount of gas discharged from the air chamber needs to be increased with an increase in the fuel vapor concentration in the air chamber.

Accordingly, the fuel storage apparatus according to the above aspect of the invention may further include predetermined value changing means for changing the above-indicated predetermined value depending upon the fuel vapor. concentration in the air chamber that is detected by the concentration detecting means, when the refueling determining means determines that fuel has been supplied to the fuel tank by refueling.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein:

FIG. 13 is a flowchart exemplifying a control routine executed in order to perform fuel leakage detection in a fuel storage apparatus in accordance with a sixth embodiment of the invention;

DETAILED DESCRIPTION OF PREFERRED EMBODIMENTS

Preferred embodiments of the invention will be described hereinafter with reference to the accompanying drawings.

Figure 1:
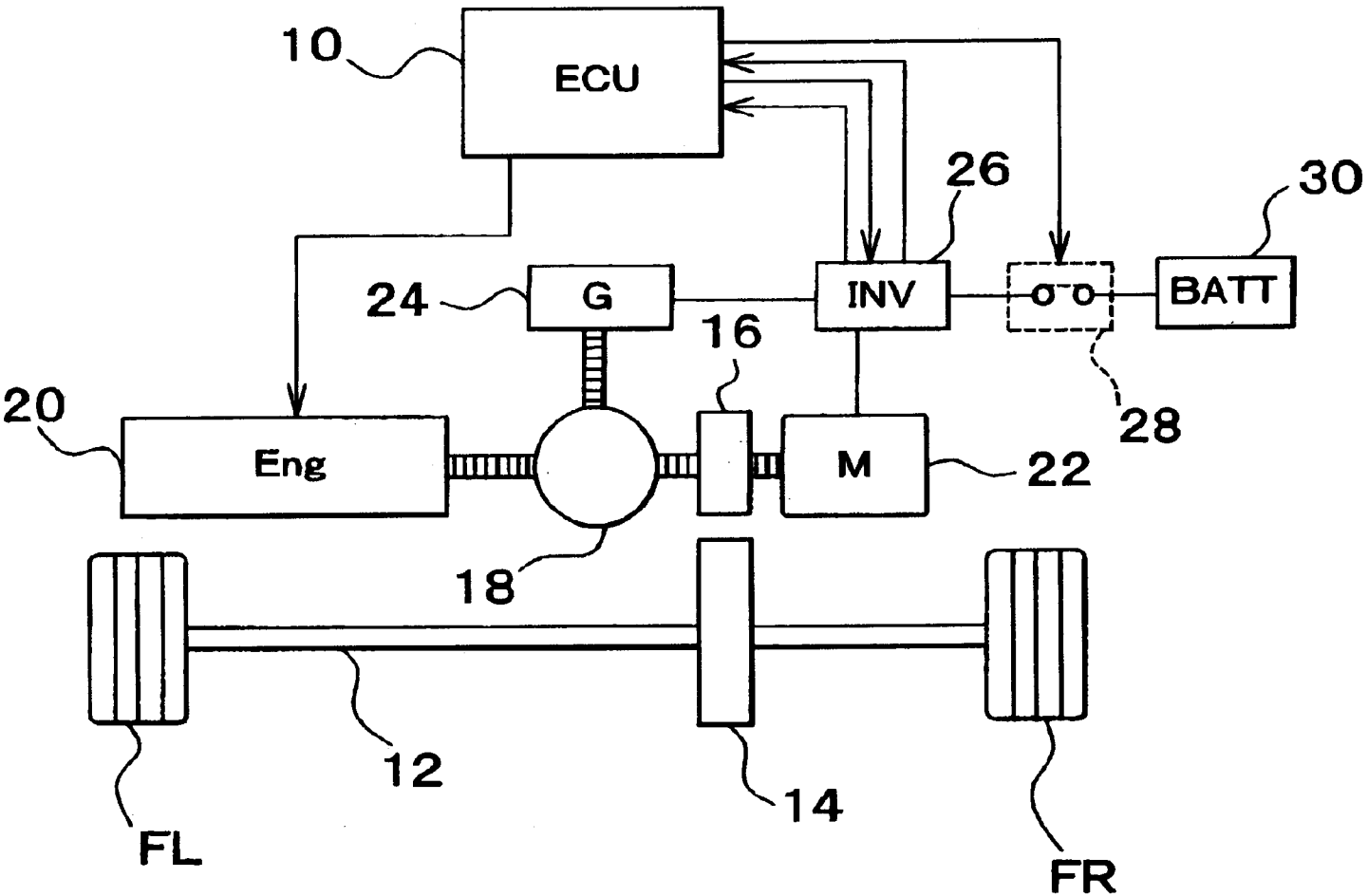
FIG. 1 is a schematic diagram illustrating a drive mechanism of a vehicle in which a fuel storage apparatus in accordance with a first embodiment of the invention is installed.

FIG. 1 is a schematic diagram of a drive mechanism of a vehicle into which a fuel storaqe apparatus in accordance with an embodiment of the invention is installed. The system in this embodiment includes an electronic control unit (hereinafter, simply referred to as "ECU" 10, and is controlled by the ECU 10. The fuel storage apparatus of this embodiment is installed in a hybrid vehicle that runs on suitable combinations of drive power sources, that is, an internal combustion engine and an electric motor, as described below.

As shown in FIG. 1, a speed reducer 14 is fixed to an axle 12 connecting a left wheel FL and a right wheel FR. A planetary gear mechanism 18 is engaged with the speed reducer 14 via a gear 16. The planetary gear mechanism 18 includes a planetary carrier connected to an output shaft of an internal combustion engine 20, a ring gear connected to an output shaft of an electric motor 22, and a sun gear connected to an output shaft of a generator 24.

The generator 24 and the electric motor 22 are electrically connected to a battery 30 via an inverter 26 and a main relay 28. The main relay 28 performs a function of closing or opening a power circuit from the battery 30 to the inverter 26 when driven by the ECU 10. The inverter 26 performs a function of conversion between direct current and three-phase alternating current using three-phase bridge circuits formed by plural transistors, between the battery 30 and the generator 24, and between the battery 30 and the electric motor 22. Power transistors in the inverter 26 are appropriately controlled by the ECU 10 so that each of the generator 24 and the electric motor 22 is controlled to a revolution speed in accordance with the frequency of alternating current, and produces a torque in accordance with the magnitude of current.

When the starting of the engine 20 is not completed, the generator 24 is supplied>with power from the battery 30 via the inverter 26 to function as a starter motor for starting the engine 20. After the starting of the engine 20 is completed, the generator 24 functions as a power generator for supplying power to the battery 30 or the electric motor 22 via the inverter 26, by using an output from the engine 20. The electric motor 22, during normal running of the vehicle, is supplied with power in an appropriate manner to function as a motor for producing torque that adds to the output of the engine 20. During braking, the electric motor 22 functions as a power generator for supplying power to the battery 30 via the inverter 26, by using rotation of the axle 12.

In this embodiment, the vehicle is a hybrid vehicle that runs by suitably combining the engine 20 and the electric motor 22. The ECU 10 calculates a drive power required for the vehicle based on the amount of operation of an accelerator and a vehicle speed, and controls the torque ratios of the engine 20 and the electric motor 22 to the axle 12 so that the engine 20 efficiently operates for the required drive power.

Figure 2:
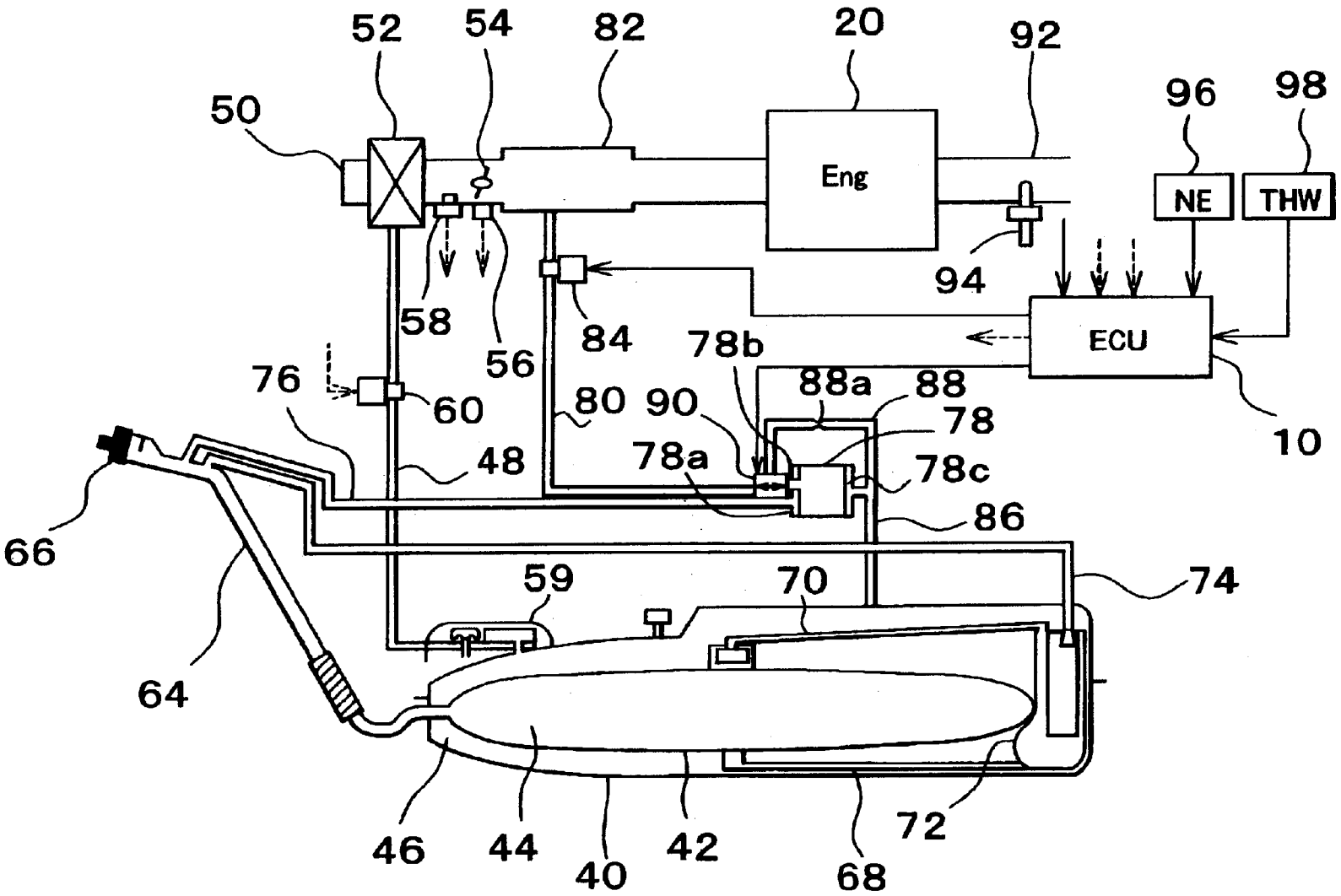
FIG. 2 is a diagram of a system construction of the fuel storage apparatus of this embodiment.

FIG. 2 is a system construction diagram of the fuel storage apparatus in this embodiment.

As shown in FIG. 2, the fuel storage apparatus of this embodiment includes a fuel tank, 40 whose outer peripheral, portion is covered with an iron member. The fuel storage apparatus prevents emission of fuel vapor formed in the fuel tank 40 into the atmosphere, and supplies fuel vapor as a fuel to the engine 20. The fuel tank 40 is divided by a bladder diaphragm 42 into a fuel chamber 44 in which fuel is stored, and an air chamber 46 filled with air. The bladder diaphragm 42 is formed by a member of an expansible-and-contractible resin or the like, and is therefore able to expand and contract within the fuel tank 40 in accordance with the amount of fuel stored in the fuel chamber 44.

The air chamber 46 is connected in communication via an introduction passage 48 to an air cleaner 52 disposed in an intake passage 50 of the engine 20. The air cleaner 52 performs a function of filtering air taken into the engine 20. A throttle valve 54 is disposed downstream of the air cleaner 52. A throttle opening degree sensor 56 is disposed near the throttle valve 54. The throttle opening degree sensor 56 outputs to the ECU 10 an electric signal in accordance with the degree of opening of the throttle valve 54. Based on the output signal of the throttle opening degree sensor 56, the ECU 10 detects the degree of opening TA of the throttle valve 54 (hereinafter, simply referred to as "throttle opening degree TA").

An air flow meter 58 is disposed between the air cleaner 52 and the throttle valve 54 in the intake passage 50. The air flow meter 58 outputs to the ECU 10 an electric signal in accordance with the mass of air passing through the air cleaner 52 per unit time. Based on the output signal of the air flow meter 58, the ECU 10 detects the mass Ga of air passing through the air cleaner 52 (hereinafter, simply referred to as "amount of intake air Ga").

A filter 59 for further purifying the air filtered by the air cleaner 52 is provided at an air chamber 46-side end of the introduction passage 48. A canister closing valve (hereinafter, referred to as "CCV") 60 is disposed in partway of the introduction passage 48. The CCV 60 is a two-position electromagnetic valve that is normally held in an open valve state and, upon supply of a drive signal from the ECU 10, is switched to a closed valve state. When the CCV 60 is open in the above-described construction, the air chamber 46 communicates with the atmosphere via the air cleaner 52.

A filler pipe 64 for supplying fuel into the fuel tank 40 is connected to the fuel chamber 44. A fuel cap 66 is. detachably connected to an upper open end of the filler pipe 64. A lower communication passage 68 is connected to a lower face of the fuel chamber 44. An upper communication passage 70 is connected to an upper face of the fuel chamber 44. The lower communication passage 68 and the upper communication passage 70 are both connected to a capacity-fixed sub-tank 72. The sub-tank 72 contains a fuel pump (not shown). Fuel pumped up by the fuel pump is regulated to a predetermined pressure, and is then supplied to a fuel injection valve (not shown) for injecting fuel into the engine 20, via a fuel supply passage (not shown).

A first vapor discharge passage 74 connected in communication to the filler pipe 64 is connected to an upper end of the sub-tank 72. The first vapor discharge passage 74 is a passage for releasing fuel vapor formed in the fuel chamber 44 and the sub-tank 72 of the fuel tank 40. A portion of the fuel vapor formed in the fuel chamber 44 and the subtank 72 liquefies when contacting fuel liquid deposited on a wall surfaces of the filler pipe 64, and is then collected into the fuel chamber 44 of the fuel tank 40.

The filler pipe 64 connects to a vapor introducing hole 78*a* of a canister 78 via a second vapor discharge passage 76. The second vapor discharge passage 76 is a passage for releasing a portion of the fuel vapor formed in the fuel chamber 44 and the sub-tank 72 that remains after liquefaction, and fuel vapor formed in the filler pipe 64. Such fuel vapor is led to the canister 78 through the second vapor discharge passage 76. The canister 78 has an activated carbon that adsorbs fuel vapor. By, adsorbing fuel vapor from the fuel chamber 44, the sub-tank 72, and the filler pipe 64, the canister 78 serves to prevent release of fuel vapor into the atmosphere.

The canister 78 has a fuel purge hole 78*b* on the same side thereof as the vapor introducing hole 78*a*. The fuel purge hole 78*b* of the canister 78 is connected to a surge tank 82 of the engine 20 via a purge passage 80. The purge passage 80 is a passage for purging fuel adsorbed in the canister 78 toward the intake passage 50. An electromagnetically driven purge valve (hereinafter a "VsV") 84 is disposed in partway of the purge passage 80. The purge VSV 84 is supplied with a duty signal from the ECU 10, and is controlled to a degree of opening corresponding to the duty ratio. The purge VSV 84 is controlled so that the amount of flow of gas, flowing in the purge passage 80 (hereinafter, referred to as "amount of purge flow") becomes equal to a predetermined value. The amount of purge flow is determined based on the engine revolution speed NE, the amount of intake air Ga, purge rate, etc., with reference to a predetermined map.

The canister 78 has an atmosphere introducing hole 78*c* on a side opposite from the vapor introducing hole 78*a* and the fuel purge hole 78*b*. The atmosphere introducing hole 78*c* of the canister 78 is connected to the air chamber 46 of the fuel tank 40 via a gas passage 86. A bypass passage 88 bypassing the canister 78 is connected to the gas passage 86 and the purge passage 80. A venturi 88*a* is provided in partway of the bypass passage 88. When gas flows through the bypass passage 88 in a normal state, the venturi 88*a* causes a flow passage resistance that is greater than the flow passage resistance to gas flowing through the canister,78. That is, the venturi 88*a* serves to make the flow passage resistance in the bypass passage 88 greater than the flow passage resistance in the canister 78 in a normal state.

An electromagnetically driven bypass VSV90 is disposed in a connecting portion of the bypass passage 88 to the purge passage 80. The bypass VSV 90 is a change valve that changes between a state of connecting the surge tank 82 and the canister 78 in communication and a state of connecting the surge tank 82 50 and the air chamber 46 in communication. The bypass VsV 90 is a two-position electromagnetic valve that is held so as to connect the surge tank 82 to the canister 78 in a normal state and, upon supply of a drive signal from the ECU 10, is operated so as to connect the surge tank 82 directly to the air chamber 46, bypassing the canister 78.

An $O_2$ sensor 94 is disposed in an exhaust passage 92 of the engine 20. The $O_2$ sensor 94 outputs to the ECU 10 an electric signal in accordance with the oxygen concentration in 10 exhaust gas flowing in the exhaust passage 92. The oxygen concentration in exhaust gas becomes lower when the air-fuel ratio of a mixture supplied into a cylinder of the engine 20 is on a rich side of a theoretical air-fuel ratio. When the air-fuel ratio is on a lean side of the theoretical air-fuel ratio, the oxygen concentration in exhaust gas becomes higher. When the air-fuel ratio is on the rich side, the $O_2$ sensor 94 outputs a high signal of about 0.9 V. When the air-fuel ratio is on the lean side, the $O_2$ sensor 94 outputs a low signal of about 0.1 V. Based on the output signal of the $O_2$ sensor 94, the ECU 10 determines whether the air-fuel ratio is on the rich side or whether the air-fuel ratio is on the lean side.

A crank angle sensor 96 and a water temperature sensor 98 are connected to the ECU 10. The crank angle sensor 96 generates a reference signal every time the rotational angle of a crankshaft of the engine 20 reaches a predetermined rotational angle. The crank angle sensor 96 also generates a pulse signal every time the crankshaft turns a predetermined rotational angle. The water temperature sensor 98 outputs an electric signal in accordance with the temperature of cooing water for cooling the engine 20. Based on the output signals of the crank angle sensor 96, the ECU 10 detects the engine revolution speed NE and the revolution angle of the engine 20. Furthermore, based on the output signal of the water temperature sensor 98, the ECU 10 detects the cooling water temperature THW (hereinafter, referred to as "water temperature TRW").

The operation of the system of this embodiment will next be described.

In the system of the embodiment, fuel vapor formed in the fuel chamber 44 of the fuel tank 40 and the sub-tank 72 is led to the second vapor discharge passage 76 via a route through the upper communication passage 70 and the first vapor discharge passage 74 and via a route through the filler pipe 64, and is then adsorbed to activated carbon in the canister 78.

When the engine 20 is in an operating state, a negative pressure is introduced into the surge tank 82. If the CCV 60 and the purge VSV 84 are opened under this condition, air flows through a route of the air cleaner 52, the introduction passage 48, the air chamber 46, the gas passage 86, the atmosphere introducing hole 78*c* and the fuel purge hole 78*b* of the canister 78, the purge passage 80, and the surge tank 82. In this case, fuel adsorbed in the canister 78 desorbs from the activated carbon, and is purged together with air into the purge passage 80. Hereinafter, a mixture of fuel and air flowing through the purge passage 80 to the intake passage 50 will be referred to as "purge gas".

Purge gas purged into the purge passage 80 flows into the surge tank 82, and then is taken into the cylinder of the engine 20, together with air flowing from the air cleaner 52 into the surge tank 82 via the throttle valve 54. Therefore, according to the system of this embodiment, fuel vapor formed in the fuel tank 40 can be supplied as a fuel into the engine 20 without being released into the atmosphere.

In order to secure good exhaust emissions from the engine 20, it is necessary to keep the air-fuel ratio A/F at a value near the theoretical air-fuel ratio A/F0. When purge. gas is not being purged from the canister 78 toward the intake passage 50, it becomes possible to secure good exhaust emissions by setting a fuel injection duration TAU such that the ratio between the amount of intake air and the amount of fuel injected from the fuel injection valve equals the theoretical air-fuel ratio A/F0. However, in order to secure good exhaust emissions under a condition that purge gas is being purged toward the intake passage 50, it is necessary to shorten the fuel injection duration TAU set through the aforementioned technique by an amount of time corresponding to the amount of fuel contained in the purge gas.

In this embodiment, the fuel injection duration TAU is feedback-controlled so that the actual air-fuel ratio A/F becomes equal to the theoretical air-fuel ratio A/F0. That is, the fuel injection duration TAU is calculated as in the following equation:

$$TAU=TP\cdot\{1+(FAF-1.0)+(KG-1.0)+FPG\} \quad (1)$$

In equation (1), TP is a basic fuel injection duration determined by the engine revolution speed NE and the amount of intake air Ga; FAF is a feedback, correction factor for reducing the deviation between the actual air-fuel ratio A/F and the theoretical air-fuel ratio A/F0, and fluctuates about "1.0"; KG is an air-fuel ratio learning correction factor for absorbing an over-time change, an individual variation and the like of the engine 20, and fluctuates about "1.0"; and FPG is a purge correction factor for compensating for a deviation of the air-fuel ratio changed due to the purge of fuel from the canister 78.

The air-fuel ratio learning correction factor KG is updated to a reduced value when the actual air-fuel ratio A/F tends to deviate to the fuel-rich side. The air-fuel ratio learning correction factor KG is updated to an increased value when the actual air-fuel ratio A/F tends to deviate to the fuel-lean side. The air-fuel ratio learning correction factor KG is calculated every skip of the feedback correction factor FAF. The learning thereof is completed when the actual air-fuel ratio A/F is not deviated either toward the fuel-rice side or toward the fuel-lean side.

The purge correction factor FPG is determined by multiplying the volume ratio of the amount of purge flow to, the amount of intake air Ga (hereinafter, referred to as "purge rate PGR") by a vapor concentration correction factor FGPG for compensating for the deviation of the air-fuel ratio caused by purge, which factor indicates the vapor concentration per purge rate of 1%. The vapor concentration. correction factor FGPG is determined by accumulating an amount of change ΔFAFAV (=FAFAV−1.0) from "1.0" of a mean value FAFAV in every predetermined skip of the feedback correction factor FAF. The vapor concentration correction factor FGPG decreases (increases toward a negative side) with increases in the amount of vapor, contained in purge gas, that is, with increases in the vapor concentration. In this embodiment, the vapor concentration is calculated from the value of the vapor concentration correction factor FGPG.

Figures 3A, 3B, 3C, 3D:
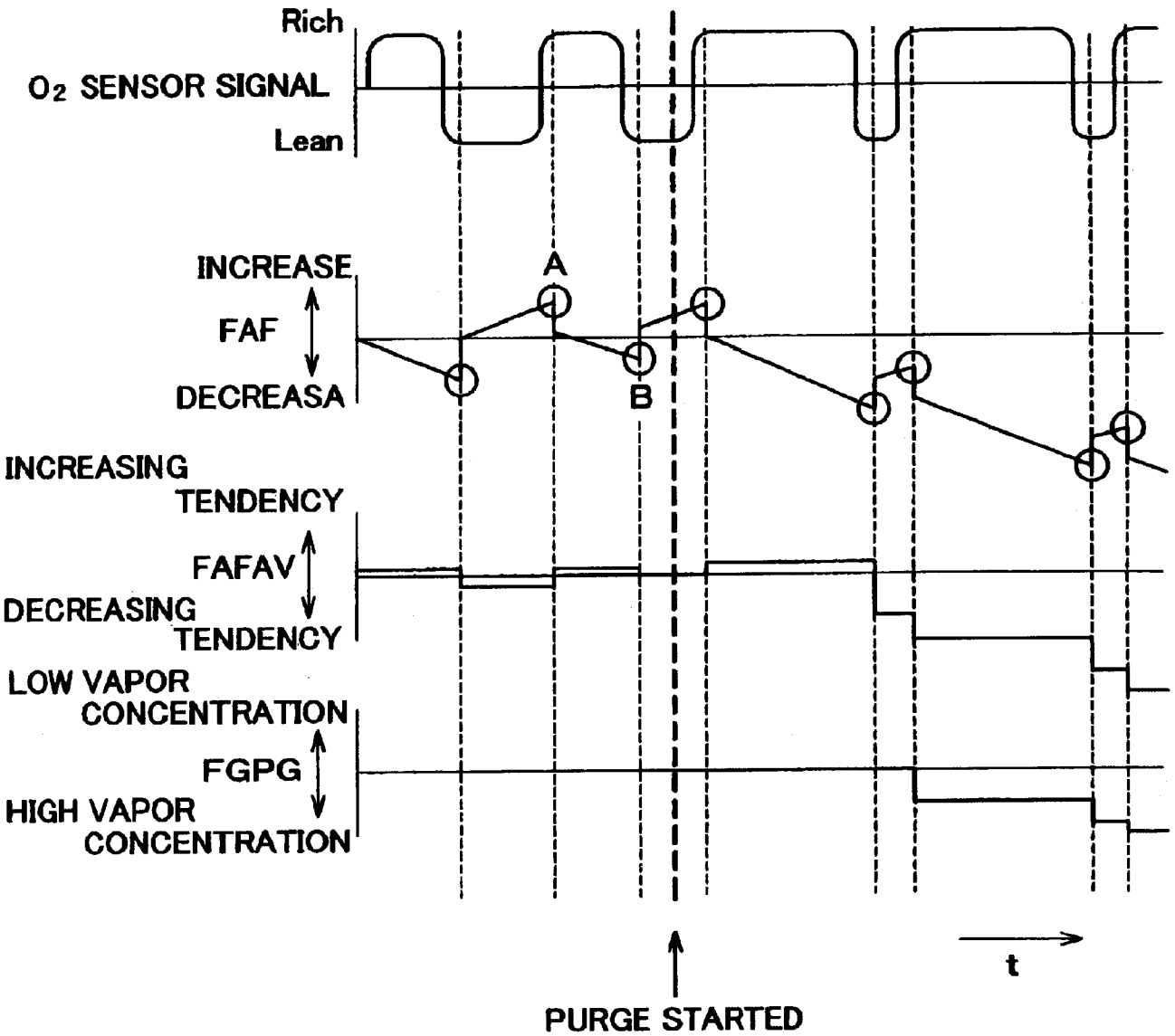
FIGS. 3A to 3D are diagrams for illustrating a technique for calculating a vapor concentration correction factor.

FIGS. 3A to 3D are diagrams for illustrating a technique for calculating the vapor concentration correction factor FGPG. FIG. 3A indicates changes in the output signal of the $O_2$ sensor 94 over time. FIG. 3B indicates over-time changes in the feedback correction factor FAF occurring with the over-time changes in the output signal of the $O_2$ sensor 94 indicated in FIG. 3A. FIG. 3C indicates over-time changes in the mean value FAFAV occurring with the over-time changes in the feedback correction factor FAF indicated in FIG. 3B. FIG. 3D indicates over-time changes in the vapor concentration correction factor FGPG occurring with the over-time changes in the mean value FAFAV indicated in FIG. 3C.

After the purge toward the intake passage 50 starts, the feedback correction factor FAF decreases as the air-fuel ratio tends to shift toward a richer side, as indicated in FIGS. 3A to 3D. The mean value FAFAV of the feedback correction factor FAF also decreases with a time delay. As ΔFAFAV decreases, the vapor concentration correction factor FGPG decreases with a time delay. After the purge toward the intake passage 50 is stopped, the feedback correction factor FAF increases as the air-fuel ratio tends to shift toward a leaner side. The mean value FAFAV and the vapor concentration correction factor FGPG also increase with their respective time delays. If the amount of change ΔFAFAV is smaller than a predetermined value, the amount of change ΔFAFAV is not accumulated but the existing value of the vapor concentration correction factor FGPG is maintained.

In this embodiment, when the actual air-fuel ratio A/F shifts toward the richer side due to purge toward the intake passage 50, the feedback correction factor FAF is reduced so as to bring the actual air-fuel ratio A/F to the theoretical air-fuel ratio A/F0. In this case, since the feedback correction factor FAF decreases with increases in the vapor concentration, the vapor concentration can be grasped based on the amount of decrease in the feedback correction factor FAF. If the feedback correction factor FAF decreases due to purge toward the intake passage 50, the purge correction factor FPG is reduced by reducing the vapor concentration correction factor FGPG, and the decreased feedback correction factor FAF is increased by an amount corresponding to the amount of decrease in the purge correction factor FPG. By this technique, the fuel injection duration TAU of the fuel injection valve can be shortened by an amount of time corresponding to the amount of fuel contained in the purge gas flowing toward the intake passage 50.

Thus, the evaporative purge system of this embodiment is operable to supply fuel vapor generated in the fuel tank 40, as a fuel, to the internal combustion engine 20, without releasing the fuel vapor into the atmosphere. If a hole is formed in man evaporative system including the fuel tank 40 and flow paths, such as the introduction passage 48 and the purge passage 80 connecting the intake passage 50 and the surge tank 82 with the air chamber 46 of the fuel tank 40, respectively, the evaporative system can no longer fulfill its function. In order to cause the system of this embodiment to function properly, therefore, it is necessary to determine without fail whether a hole is present in the evaporative system or not. The determination as to whether any hole is formed in the evaporative system will be hereinafter called "hole detection in evaporative system".

In this embodiment, if conditions for executing hole detection in the evaporative system are satisfied during purge, the CCV 68 is closed. In this case, gas within the air chamber 46 flows into the surge tank 82 through the purge passage 80 due to the negative pressure or vacuum of the intake passage 50, while no new air flows from the air passage 50 into the air chamber 46 through the introduction passage 48. As a result, the pressure within the evaporative system is greatly reduced toward the negative pressure that arises in the intake passage 50. If the pressure within the evaporative system is reduced down to a predetermined negative pressure P0 (<0), the purge VSV 84 is closed so as to shut off the purge passage 80. Thus, the CCV 68 and the purge VSV 84 are placed in the closed states so that the evaporative system is fluid-tightly closed.

If no hole is present in the evaporative system, the pressure within the evaporative system gradually increases toward the positive pressure side after the evaporative system is fluid-tightly closed, as the fuel present in the evaporative system evaporates. If a hole is present in the evaporative system, on the other hand, the atmosphere flows into the evaporative system through the hole, whereby the pressure within the evaporative system increases rapidly toward the level of the atmosphere. It is thus possible to determine whether a hole is present in the evaporative system or not, by detecting the pressure in the evaporative system after fluid-tightly closing the system under a negative pressure.

The system of the embodiment is provided with the fuel tank 40 divided into the fuel chamber 44 and the air chamber 46 by the bladder diaphragm 42, as described above. If there is a hole in the bladder diaphragm 42 of the fuel tank 40, or if a connecting portion of the lower communication passage 68 or the upper communication passage 70 to the fuel chamber 44 is disconnected, or if there is a crack in the lower communication passage 68 or the upper communication passage 70, fuel may leak from the fuel chamber 44 toward the air chamber 46, so that there is a danger of leakage of a portion of the fuel vapor into the atmosphere. Therefore, in the system of the embodiment, it is necessary to diagnose whether there is fuel leakage from the fuel chamber 44 to the air chamber 46 caused by an abnormality in the system as mentioned above. Hereinafter, this diagnostic will be termed fuel leakage detection.

If there is no fuel leakage from the fuel chamber 44 to the air chamber 46, the vapor concentration in the air chamber 46 remains very low. Conversely, if there is fuel leakage, the vapor concentration in the air chamber 46 is high. Therefore, by detecting the vapor concentration in the air chamber 46, it becomes possible to detect whether there is fuel leakage from the fuel chamber 44 to the air chamber 46.

In this embodiment, therefore, the fuel leakage detection is performed based on the vapor concentration correction factor FGPG provided after the surge tank 82 and the air chamber 46 are directly connected in communication by driving the bypass VSV 90. If the vapor concentration correction factor FGPG becomes a value near "0", it can be considered that there is not much fuel vapor in the air chamber 46, so that it can be considered that there is no fuel leakage from the fuel chamber 44 to the air chamber 46. If the vapor concentration correction factor FGPG increases to the negative side, it can be considered that a large amount of fuel vapor exists in the air chamber 46, so that it can be considered that there is fuel leakage from the fuel chamber 44 to the air chamber 46.

If fuel is not purged from the canister 7B toward the intake passage 50 for a long continued period, the amount of fuel vapor adsorbed in the canister 78 becomes great so that the canister 78 becomes saturated. In such a case, there is a danger that the vapor concentration in the air chamber 46 will become high due to fuel leakage from the atmosphere introducing hole 78*c*-side of the canister 78 toward the air chamber 46. Furthermore, if the fuel tank 40 is used for a long time, there is a danger of a high vapor concentration in the air chamber 46 because the amount of fuel vapor that flows from the fuel chamber 44 into the air chamber 46, permeating through the bladder diaphragm 42, becomes great.

In this embodiment, the vapor concentration is calculated based on the vapor concentration correction factor FGPG detected based on a change in the air-fuel ratio, as mentioned above. When the engine 20 is in a transitional state, the air-fuel ratio remarkably fluctuates. Therefore, under a condition that the engine 20 is in a transitional state, the above-described construction becomes unable to accurately detect the vapor concentration in the air chamber 46 due to the remarkable fluctuations in the vapor concentration correction factor FGPG.

Thus, in some cases, the vapor concentration in the air chamber 46 becomes high, or the vapor concentration in the air chamber 46 cannot be accurately detected, even though the system has no abnormality caused by a membrane hole formed in the bladder diaphragm 42, a disconnected pipe in the piping to the fuel chamber 44, or the like. If in such a case, it is determined whether there is fuel leakage from the fuel chamber 44 to the air chamber 46, it may be falsely determined that there is, fuel leakage. Therefore, the system of this embodiment prevents a false determination regarding fuel leakage from the fuel chamber 44 to the air chamber 46, by, using a technique described below.

Figure 4:
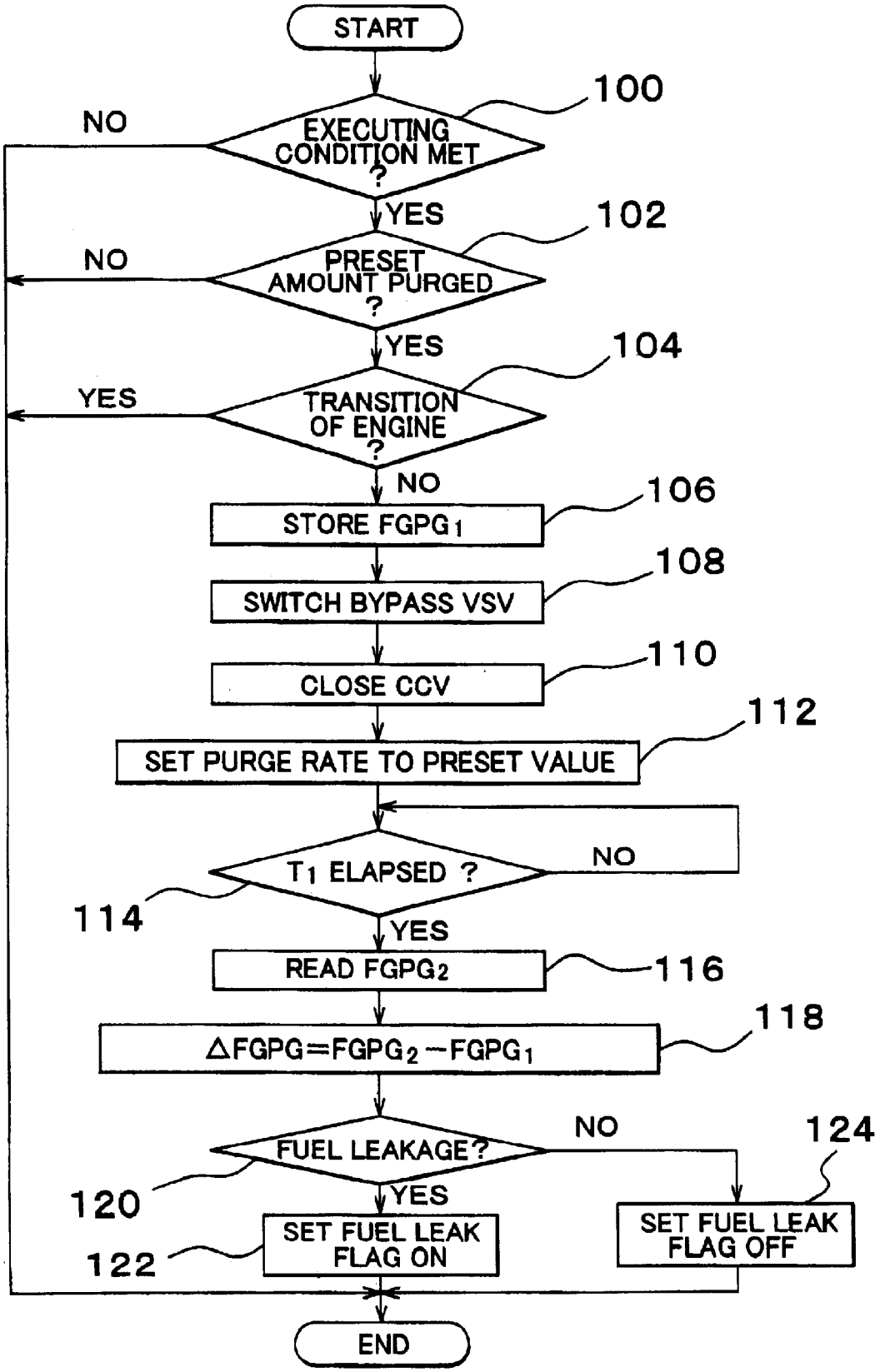
FIG. 4 is a flowchart exemplifying a control routine executed in order to perform fuel leakage detection in the fuel storage apparatus of the embodiment.

FIG. 4 is a flowchart exemplifying a control routine executed by the ECU 10 to determine whether there is fuel leakage from the fuel chamber 44 to the air chamber 46. The routine shown in FIG. 4 is started repeatedly every time the routine ends. When the routine of FIG. 4 is started, the ECU 10 first executes a process of step 100.

In step 100, the ECU 10 determines whether a condition for executing the fuel leakage detection is met. This executing condition is met in a case where the purge VSV 84 is opened during operation of the engine 20 so as to purge fuel adsorbed in the canister 78 toward the intake passage 50 and where the water temperature THW at the time of the start of the engine 20 is low. If it is determined that the executing condition is not met, the ECU 10 ends the present execution of the routine without executing any further processing conversely, if it is determined that the executing condition is met, the ECU 10 subsequently executes a process of step 102.

In step 102, the ECU 10 determines whether the accumulation of purge flow has reached at predetermined value following the start of purge of fuel from the canister 78 to the intake passage 50. If it is determined that the accumulation of purge flow has not reached the predetermined value, the ECU 10 ends the present execution of the routine. Conversely, if it is determined that the accumulation of purge flow has reached the predetermined value, the ECU 10 subsequently executes a process of step 104.

In step 104, the ECU 10 determines whether the engine 20 is in a transitional state. More specifically, it is determined whether the absolute value of an amount of change in the engine revolution speed NE per unit time (hereinafter, referred to as "changing rate $|\Delta NE/\Delta t|$") is greater than a predetermined value $C_{NE}$, or whether the absolute value of an amount of change in the amount of intake air Ga per unit time (hereinafter referred to as "changing rate $|\Delta Ga/\Delta t|$") is greater than a predetermined value $C_{GA}$. The predetermined value $C_{NE}$ is a maximum value of the changing rate of the engine revolution speed NE that allows the determination that the engine 20 is operating in a steady, state. The predetermined value $C_{GA}$ is a maximum value of the changing rate of the amount of intake air Ga that allows the determination that the engine 20 is operating in a steady state.

=In step 104, if either $|\Delta NE/\Delta t|>C_{NE}$ or $|\Delta Ga/\Delta t|>C_{GA}$ holds, it can be considered that the engine is in the transitional state. In this case, the amount of fuel injected from the injection value into the cylinder of the engine 20 remarkably fluctuates, so that the fluctuation of the air-fuel ratio becomes great, and therefore the vapor concentration cannot be accurately detected. As a result, it becomes impossible to accurately determine whether there is fuel leakage from the fuel chamber 44 to the air chamber 46. Therefore, if it is determined that either $|\Delta NE/\Delta t|>C_{NE}$ or $|\Delta Ga/\Delta t|>C_{CA}$ holds, the ECU 10 ends the present execution of the routine.

Conversely, if neither $|\Delta NE/\Delta t|>C_{NE}$ nor $|\Delta Ga/\Delta t|>C_{GA}$, holds, it can be considered that the engine 20 is in the steady state. Therefore, the fluctuation of the air-fuel ratio is small, and the vapor concentration can be accurately detected. Hence, if it is determined that neither $|\Delta NE/\Delta t|>C_{NE}$ nor $|\Delta Ga/\Delta t|>C_{GA}$ holds, the ECU 10 subsequently executes a process of step 106.

In step 106, the ECU 10 executes a process of storing the vapor concentration correction factor FGPG provided at the time of execution of step 106, as FGPG1. In this case, the vapor concentration correction factor FGPG assumes a value corresponding to the vapor concentration in the purge gas purged from the canister 78 toward the intake passage 50. More specifically, the vapor concentration correction factor FGPG assumes a great value to the negative side if the vapor concentration is high. As the, vapor concentration becomes lower, the vapor concentration correction factor FGPG becomes closer to "0".

In step 108, the ECU 10 executes a process of supplying a drive signal to the bypass VSV 90. Due to execution of the process of step 108, the surge tank 82 becomes and will remain directly connected in communication to the air chamber 46, bypassing the canister 78.

Subsequently in step 110, the ECU 10 executes a process of supplying a drive signal to the CCV 60. Due to execution of the process of step 110, the introduction passage 48 connecting the intake passage 50 and the air chamber 46 becomes and will remain closed.

Subsequently in step 112, the ECU 10 executes a process of duty-driving the purge VSV 84 so that the purge rate PGR of gas purged from the air chamber 46 toward the intake passage 50 via the bypass passage 88 and the purge passage 80 becomes equal to a constant value PGR0 that is set to a relatively great value. Due to execution of the process of step 112, the purge VSV 84 becomes and will remain opened to a degree of opening corresponding to the duty ratio, so that the purge rate of gas purged from the air chamber 46 toward the intake passage 50 is kept at a constant value.

Subsequently in step 114, the ECU 10 determines whether a predetermined length of time T1 has elapsed following the. start of the process of step 112. The predetermined length of time T1 is set to a summed time (T11+T12) obtained by summing a time T11 that is expected to elapse, following the supply of the drive signal to the bypass VSV 90, before gas from the air chamber 46 reaches the $O_2$ sensor 94 so that the vapor concentration correction factor FGPG becomes a value corresponding t6, the vapor concentration in the gas present in the air chamber 46 (hereinafter, referred to as "response delay time") and a time T12 that is expected to elapse before the accumulation of amounts of purge flow of gas purged from the air chamber 46 toward the intake passage 50 reaches a predetermined value. The process of step 114 is repeatedly executed until it is determined that the predetermined length of time T1 has elapsed. When it is determined that the predetermined length of time T1 has elapsed, the ECU 10 subsequently executes a process of step 116.

In step 116, the ECU 10 executes a process of reading or inputting the vapor concentration correction factor FGPG provided at the time of execution of step 116, as FGPG2. In this case, the vapor concentration correction<factor FGPG. assumes a value corresponding to the vapor concentration in the gas purged from the air chamber 46 directly to the intake passage 50.

Subsequently in step 118, the ECU 10 executes a process of calculating a difference ΔFGPG (=FGPG2−FGPG1) between the FGPG2 read in step 116 and FGPG1 stored in step 106.

Subsequently in step 120, the ECU 10 determines whether there is fuel leakage from the fuel chamber 44 to the air chamber 46.

Figure 5:
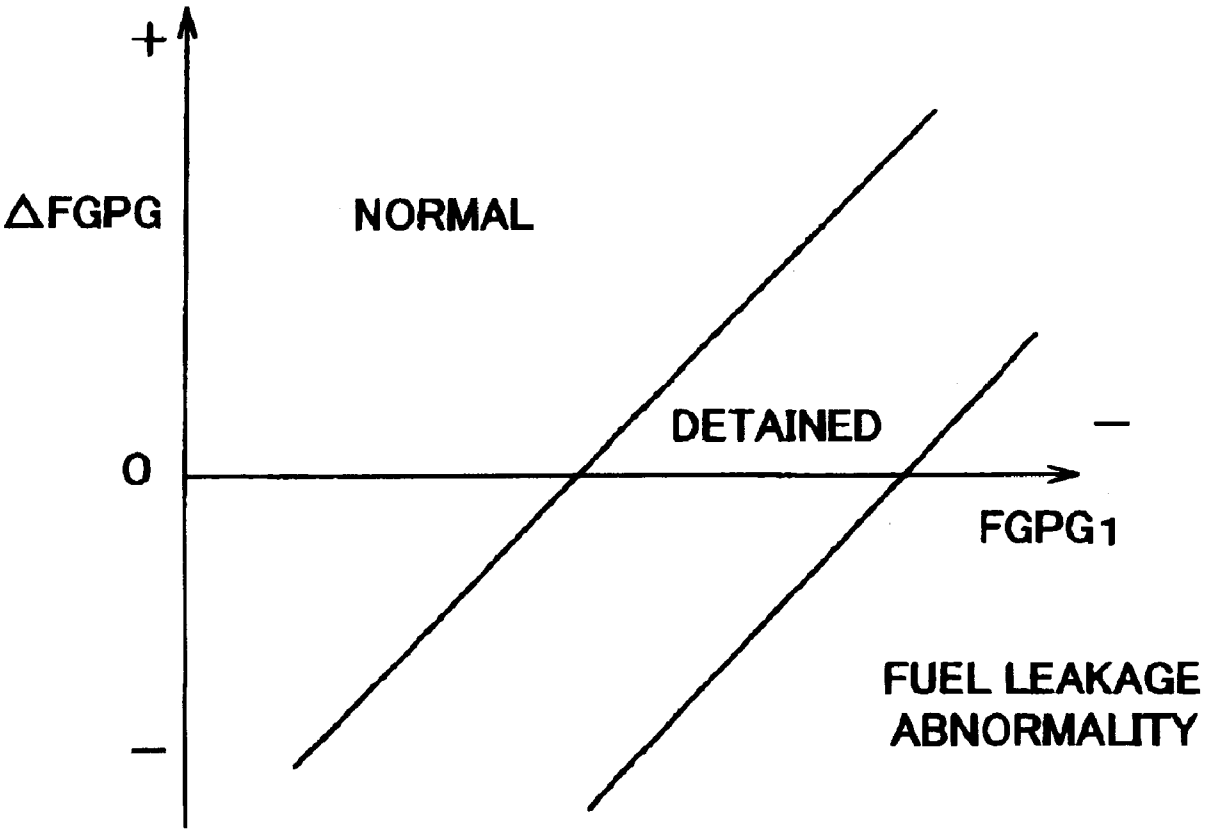
FIG. 5 indicates a map expressing a relationship between ΔFGPG and FGPG1 for use in determining whether there is fuel leakage from the fuel chamber to the air chamber in the, embodiment.

FIG. 5 is a diagram indicating a map expressing a relationship between ΔFGPG and FGPG1, which map is used to determine whether there is fuel leakage from the fuel chamber 44 to the air chamber 46. FGPG1 becomes a great value to the negative side when a large amount of fuel is adsorbed in the canister 78. As the amount of fuel adsorbed in the canister 78 decreases, the value of FGPG1 becomes closer to "0". FGPG2 becomes a great value to the negative side if there is fuel leakage from the fuel chamber 44 to the air chamber 46. Conversely, when there is no fuel leakage from the fuel chamber 44 to the air chamber 46, FGPG2 becomes a value near "0".

In step 120, the ECU 10 determines whether there is fuel leakage from the fuel chamber 44 to the air chamber 46 by referring to the map indicated in FIG. 5. If it is determined that there is fuel leakage from the fuel chamber 44 to the air chamber 46, the ECU 10 subsequently executes a process of step 122. Conversely, if it is determined that there is no fuel leakage from the fuel chamber 44 to the air chamber 46, the ECU 10 subsequently executes a process of step 124.

In step 122, the ECU 10 executes a process of setting up a fuel leakage flag FLAG indicating that there is fuel leakage from the fuel chamber 44 to the air chamber 46. When this flag is set up, an alarm is produced and an alarm lamp is turned on for an occupant in the vehicle so as to inform the occupant of the abnormality of fuel leakage from the fuel chamber 44 to the air chamber 46. It is also possible to activate the alarm or the alarm lamp if the flag is set up successively at least twice.

In step 124, ECU 10 executes a process of resetting the fuel leakage flag FLAG. After the process of step 122 or step 124 ends, the ECU 10 ends the present execution of the routine.

According to the processes described above, it is possible to prohibit the determination as to whether there is fuel leakage from the fuel chamber 44 to the air chamber 46, if the engine 20 is in the transitional state. That is, the embodiment allows the fuel leakage detection to be performed when the engine 20 is in the steady state. Therefore, the embodiment avoids an event that the air-fuel ratio fluctuates due to the transitional state of the engine 20 during the determination regarding the presence/absence of fuel leakage from the fuel chamber 44 to the air chamber 46, and therefore makes it possible to accurately detect the vapor concentration in the air chamber 46. Thus, the fuel storage apparatus of this embodiment is able to prevent a false determination regarding the presence/absence of fuel leakage from the fuel chamber 44 to the air chamber 46 attributed to the situation where the engine is in the transitional state.

Furthermore, according to the above-described processes, when the fuel leakage detection executing condition is met, the fuel leakage detection can be performed after the amount of purge flow of gas purged from the canister 78 toward the intake passage 50 reaches the predetermined amount. That is, fuel adsorbed in the canister 78 can be purged to some extent toward the intake passage 50 before the fuel leakage detection is performed. Therefore, according to the embodiment, even if the canister 78 is saturated so that fuel leaks from the atmosphere introducing hole 78*c* of the canister 78 to the air chamber 46 through the gas passage 86, the saturated state of the canister 78 can be resolved before the fuel leakage detection. Hence, the fuel storage apparatus of this embodiment avoids an event that the vapor concentration in the air chamber 46 becomes high due to the saturation of the canister 78 during the fuel leakage detection, and therefore is able to prevent a false determination regarding the presence/absence of fuel leakage from the fuel chamber 44 to the air chamber 46.

Still further, according to the above-described processes, the vapor concentration in the air chamber 46 can be detected while the purge rate of gas from the air chamber 46 to the intake passage 50 is kept at a relatively great contact value. If the purge rate is small, the fluctuation in the air-fuel ratio caused by the purge also becomes small, so that the difference between the actual vapor concentration and the vapor concentration estimated from the vapor concentration correction factor FGPG becomes great. In the above-described embodiment, however, the purge rate is kept at a relatively great value during the fuel leakage detection as mentioned above. Therefore, the embodiment avoids an event that the difference between the actual vapor concentration and the vapor concentration estimated from the vapor concentration correction factor FGPG becomes great, and therefore makes it possible to prevent a false determination regarding the presence/absence of fuel leakage from the fuel chamber 44 to the air chamber 46 attributed to the aforementioned difference in vapor concentration.

Furthermore, according to the above-described embodiment, after purge of gas from the air chamber 46 to the intake passage 50 starts upon supply of the drive signal to the bypass VSV 90, the vapor concentration correction factor FGPG provided after the elapse of a time (response delay time T11) that is expected to elapse before the vapor concentration correction factor FGPG reaches a value corresponding to the vapor concentration in the gas present in the air chamber 46, can be recognized as the vapor concentration in the air chamber 46. That is, after gas in the air chamber 46 is purged toward the intake passage 50, the vapor concentration in the air chamber 46 can be detected taking into consideration the response delay time T11 of the vapor concentration correction factor FGPG. Therefore, in this embodiment, it is possible to prevent a false detection of the vapor concentration in the air chamber 46 attributed to disregard of the response delay time T11 of the vapor. concentration correction factor FGPG. Hence, the fuel storage apparatus of the embodiment is able to prevent a false determination regarding the presence/absence of fuel leakage from the fuel chamber 44 to the air chamber 46 attributed to a response delay of the vapor concentration correction factor FGPG.

According to the embodiment, after purge of gas from the air chamber 46 to the intake passage 50 starts, the vapor concentration correction factor FGPG provided after the elapse of the time T12 that is expected to elapse before the accumulation of amounts of purge flow of the gas reaches at least the predetermined value following the elapse of the response delay time T11 of the vapor concentration correction factor FGPG, can be recognized as a vapor concentration in the air chamber 46 that is used for the fuel leakage detection. That is, after purge of gas from the air chamber 46 to the intake passage 50 starts, the fuel leakage detection can be performed based on the vapor concentration occurring in the air chamber 46 after a certain amount of gas has been purged from the air chamber 46 toward the intake passage 50. Therefore, even if a large amount of fuel flows into the air chamber 46 due to permeation through the bladder diaphragm 42 from the fuel chamber 44 or leak from the atmosphere introducing hole 78*c* of the canister 78 after saturation of the canister 78, that is, if the vapor concentration in the air chamber 46 becomes high due to a factor other than abnormalities in the system that include a membrane hole in the bladder diaphragm 42, disconnection of a connecting portion of the piping, a crack in such a connecting portion, etc., the fuel leakage detection will not be performed based on the vapor concentration in the air chamber 46.

If there is an abnormality in the system, such as a membrane hole in the bladder diaphragm 42, disconnection or cracking in the piping to the fuel chamber 44, etc., the vapor concentration in the air chamber 46 becomes high within a short time after gas has been discharged from the air chamber 46 to the intake passage 50. Conversely, if there is no abnormality in the system, the vapor concentration in the air chamber 46 is not increased due to permeation through the bladder diaphragm 42 or saturation of the canister 78 within a short time after gas has been discharged from the air chamber 46 to the intake passage 50. Therefore, after purge of gas from the air chamber 46 to the intake passage 50 starts, it can be accurately detected whether there is fuel leakage from the fuel chamber 44 to the air chamber 46 caused by an abnormality in the system, by detecting the vapor concentration occurring in the air chamber 46 after a certain amount of gas has been discharged from the air chamber 46 to the intake passage 50. Hence, the fuel storage apparatus of the embodiment is able to reliably prevent a false determination regarding the presence/absence of fuel leakage from the fuel chamber 44 to the air chamber 46 even under, for example, a condition where fuel permeates from the fuel chamber 44 to the air chamber 46.

In the foregoing embodiment, every time the fuel leakage detection is to be performed, a certain amount of gas is discharged from the air chamber 46 to the intake passage 50 in order to prevent a false determination regarding the presence/absence of fuel leakage from the fuel chamber 44 to the air chamber 46 attributed to fuel permeation or the like. However, it is also possible to discharge a fixed amount of gas from the air chamber 46 to the intake passage 50 only when it is determined that the vapor concentration in the air chamber 46 is high immediately after execution of the fuel leakage detection starts, and then execute the fuel leakage detection. It is also possible to discharge gas from the air chamber 46 to the intake passage 50 in the case of elapse of a time that is expected to elapse before the amount of fuel permeating from the fuel chamber 44 to the air chamber 46 reaches a predetermined great amount, and then execute the fuel leakage detection.

Furthermore, if the vapor concentration in gas purged from the canister 78 to the intake passage 50 is relatively high, it can be considered that a large amount of fuel vapor is formed in the fuel tank 40, and therefore it can be considered that a large amount of fuel has flown from the fuel chamber 44 into the air chamber 46, permeating through the bladder diaphragm 42. Therefore, it is also possible to discharge a fixed amount of gas from the air chamber 46 to the intake passage 50 if it is determined that the vapor concentration is high when purge from the canister 78 to the intake passage 50 is started, and then execute the fuel leakage detection.

A second embodiment of the invention will be described with reference to FIGS. 6 and 7 together with FIGS. 2 and 4.

In the first embodiment, execution of the fuel leakage detection is prohibited when the engine 20 is in the transitional state. Therefore, since the fuel leakage detection is not executed under a condition that the air-fuel ratio fluctuates due to the transitional state of the engine 20, it becomes possible to prevent a false determination as to whether there is a membrane hole in the bladder diaphragm 42.

A fuel storage apparatus of the second embodiment is installed in a hybrid vehicle as mentioned above. Therefore, in this embodiment, it becomes possible to secure a drive power required for the vehicle by changing the output torque of the electric motor 22 while maintaining a constant output torque of the engine 20. That is, it becomes possible to maintain a constant operational state of the engine 20 even under a condition that the required drive power changes.

If the fuel leakage detection is performed while a constant operational state of the engine 20 is maintained, there is no fluctuation in the air-fuel ratio caused by the transitional state of the engine 20, so that it becomes possible to accurately detect the vapor concentration in the air chamber 46, and therefore it becomes possible to prevent a false determination regarding the presence/absence of a membrane hole in the bladder diaphragm 42. Therefore, in the system of the embodiment, the engine 20 is kept in a constant operational condition regardless of the required drive power at the time of execution of the fuel leakage detection.

Figure 6:
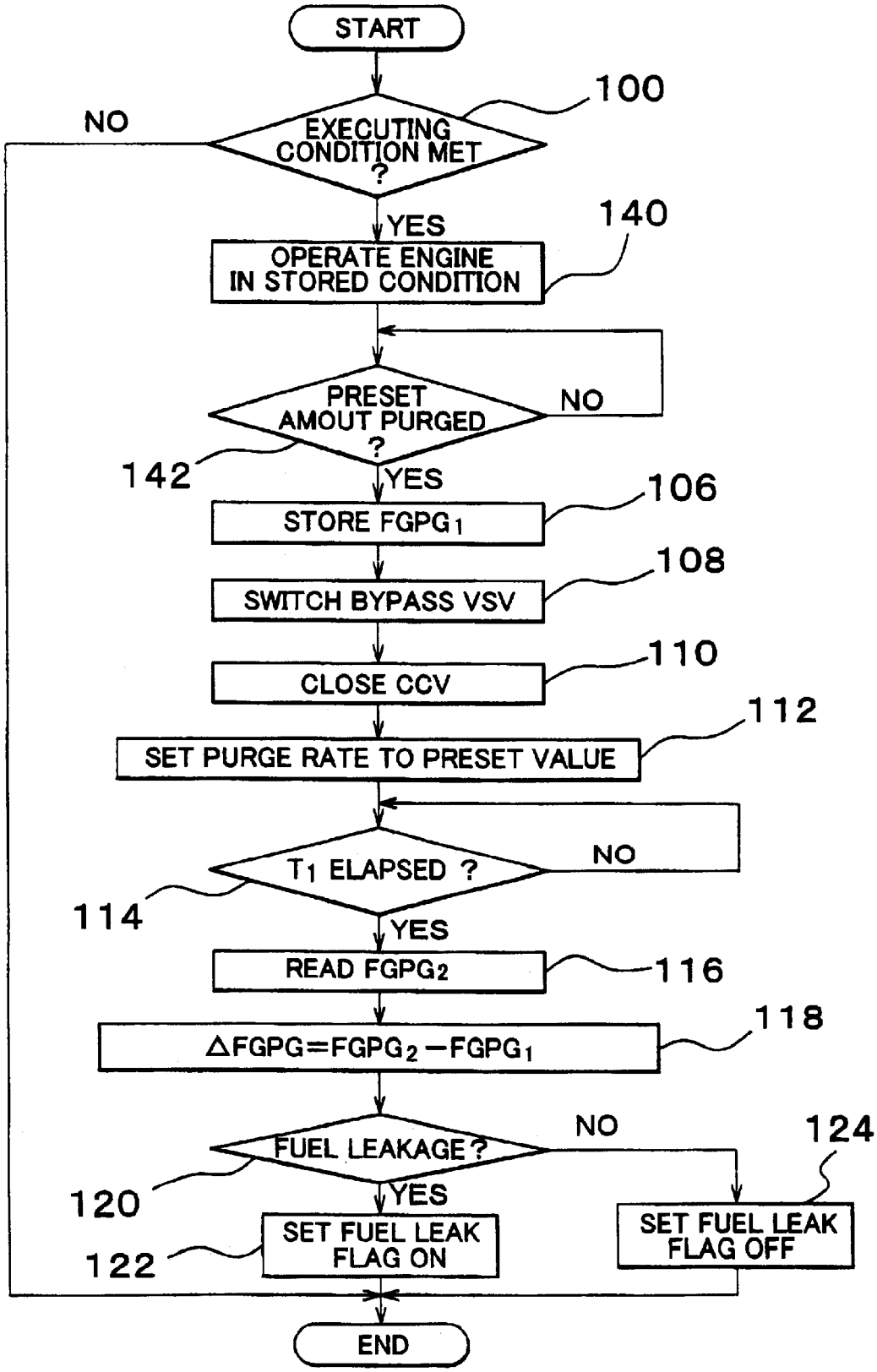
FIG. 6 is a flowchart exemplifying a control routine executed in order to perform fuel leakage detection in a fuel storage apparatus in accordance with a second embodiment of the invention.

FIG. 6 is a flowchart exemplifying a control routine executed by the ECU 10 of the fuel storage apparatus of this embodiment so as to determine whether there is fuel leakage from the fuel chamber 44 to the air chamber 46. That is, the system of the embodiment is realized by the ECU 10 executing the routine shown in FIG. 6 similar to the routine shown in FIG. 4, in which steps 140 and 142 are provided in place of steps 102 and 104 of the routine of FIG. 4.

In this embodiment, after the fuel leakage detection executing condition is met in step 100, the ECU 10 executes a process of step 140.

In step 140, the ECU 10 executes a process of keeping the engine 20 in a constant operational state.

Figure 7:
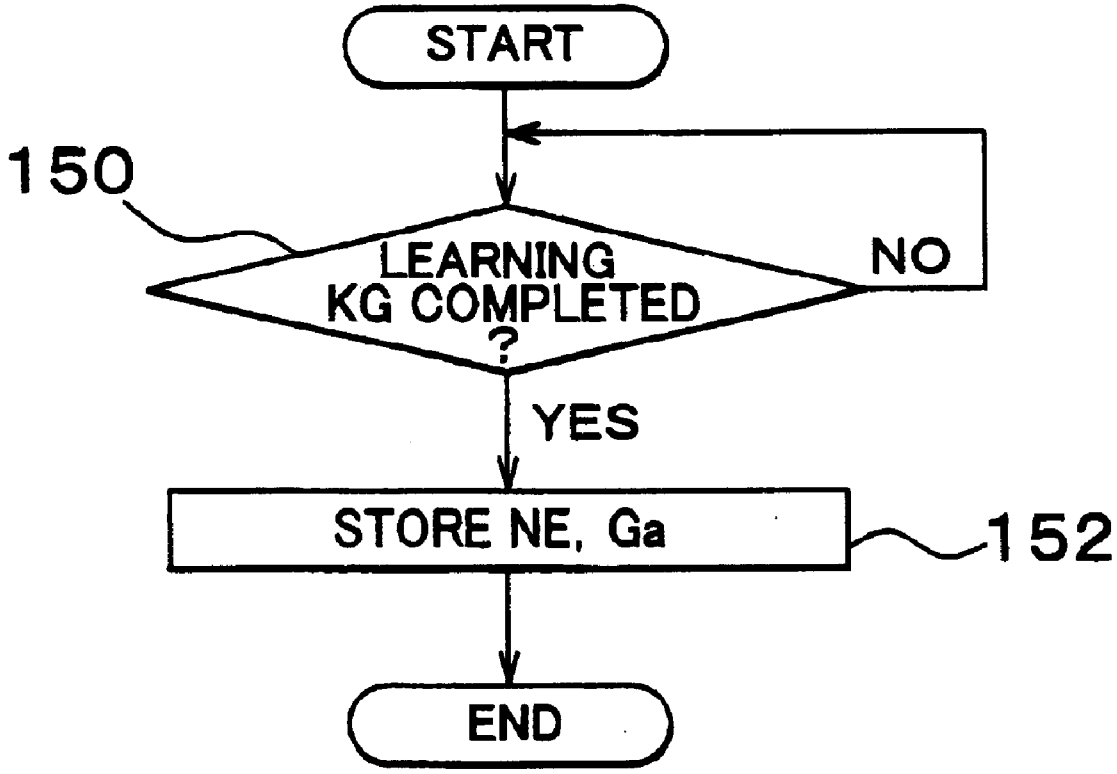
FIG. 7 is a flowchart exemplifying a sub-routine executed by an ECU in order to specify an operational state of the engine that is maintained during the fuel leakage detection in the fuel storage apparatus of the embodiment.

FIG. 7 is a flowchart exemplifying a sub-routine executed by the ECU 10 in the fuel storage apparatus of the embodiment. The routine shown in FIG. 7 is a routine that is repeatedly started every time the routine ends. When the routine of FIG. 7 is started, the ECU 10 first executes a process of step 150.

In step 150, the ECU 10 determines whether the learning of the air-fuel ratio learning correction factor Kg is completed. The process of step 150 is repeatedly executed until this condition is met. When it is determined that the learning of the air-fuel ratio learning correction factor KG is completed, the ECU 10 subsequently executes a process of step 152.

In step 152, the ECU 10 executes a process of storing the engine revolution speed NE and the amount of intake air Ga occurring at the time of executing step 150.

According to the above-described processes, the engine revolution speed NE and the amount of intake air Ga occurring at the time point when the learning of the air-fuel ratio learning correction factor KG is completed can be stored.

In step 140 in the routine shown in FIG. 6, the ECU 10 executes a process of operating the engine 20 so as to achieve the engine revolution speed NE and the amount of intake air Ga obtained by executing the routine shown in FIG. 7.

Subsequently in step 142, the ECU 10 determines whether the accumulation of amounts of purge flow has reached a predetermined value after the start of purge of fuel from the canister 78 to the intake passage 50, as in step 102 in FIG. 4. The process of step 142 is repeatedly executed until it is determined that the accumulation of amounts of purge flow has reached the predetermined value. When it is determined that the accumulation of amounts of purge flow has reached the predetermined value, the ECU 10 subsequently executes a process starting at step 106.

According to the above-described processes, the fuel leakage detection can be executed while the engine 20 is kept in a constant operational state. Therefore, the fuel storage apparatus of this embodiment is able to accurately detect the vapor concentration in the air chamber 46 during the determination regarding the presence/absence of fuel leakage from the fuel chamber 44 to the air chamber 46, as in the first embodiment. Hence, fuel storage apparatus of the embodiment is able to prevent a false determination regarding the presence/absence of fuel leakage from the fuel chamber 44 to the air chamber 46 attributed to the situation where the engine 20 is in the transitional state.

During the fuel leakage detection in this embodiment, the engine 20 operates while maintaining a state where the engine revolution speed NE and the amount of intake air Ga provided at the time point of completion of the learning of the air-fuel ratio learning correction factor KG are achieved. In this case, no error is caused in the air-fuel ratio learning correction factor KG, and the vapor concentration correction factor FGPG becomes a proper value corresponding to the vapor concentration in the air chamber 46. Therefore, in the embodiment, it is possible to prevent a false determination regarding the presence/absence of fuel leakage from the fuel chamber 44 to the air chamber 46 attributed to an error in the air-fuel ratio learning correction factor KG.

Figures 8A, 8B, 8C, 8D:
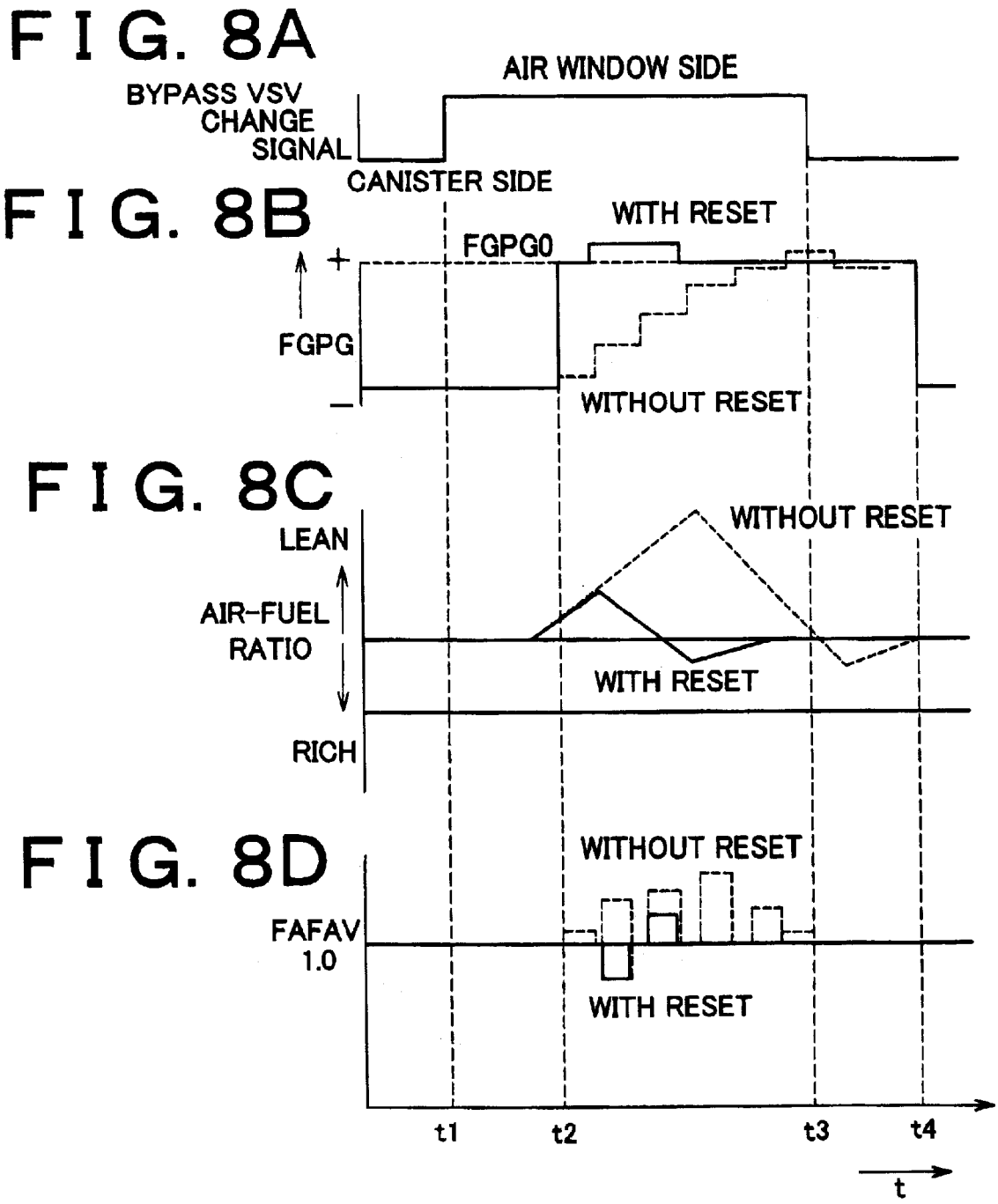
FIGS. 8A to 8D are time charts for illustrating operations performed in conjunction with the fuel leakage detection in a fuel storage apparatus in accordance with a third embodiment of the invention.

A third embodiment of the invention will be described with reference to FIGS. 8 and 9 together with FIG. 2.

FIGS. 8A to 8D are time charts for illustrating operations performed in conjunction with execution of the fuel leakage detection in the fuel storage apparatus of this embodiment. FIGS. 8A to 8D are time charts regarding the bypass VSV 90, the vapor concentration correction factor FGPG, the air-fuel ratio A/F, and the mean value FAFAV of the feedback correction factor, respectively. In FIGS. 8A to 8D, solid lines indicate a case where the vapor concentration correction factor FGPG is reset when the fuel leakage detection starts, and broken lines indicate a case where the factor is not rest at the start of the fuel leakage detection.

In this embodiment, the vapor concentration correction factor FGPG assumes a relatively great value to the negative side corresponding to the amount of fuel adsorbed in the canister 78, before the start of the determination as to whether there is fuel leakage from the fuel chamber 44 to the air chamber 46 (before a time point tl in FIGS. 8A to 8D). At the time point t1, the drive signal is supplied to the bypass VSV 90 to start the fuel leakage detection. After that, the vapor concentration correction factor FGPG changes to a value corresponding to the vapor concentration in the air chamber 46 with a predetermined response delay time.

When there is no fuel leakage from the fuel chamber 44 to the air chamber 46, the vapor concentration in the air chamber 46 is low. Therefore, if under this condition, gas is purged from the air chamber 46 to the intake passage 50 by driving the bypass VSV 90, the amount of fuel supplied to the engine 20 decreases, so that the air-fuel ratio shifts to the lean side as indicated by the broken line in FIG. 8C. When the air-fuel ratio has shifted to the lean side, it is a normal practice to increase the amount of fuel supplied to the engine 20 by correcting the vapor concentration correction factor FGPG toward a value near "0" in accordance with changes in the air-fuel ratio as indicated by the broken line in FIG. 8B. Thus, the lean-side air-fuel ratio is resolved.

However, this technique requires a great amount of time in order to bring the vapor concentration correction factor FGPG to a value near "0" in accordance with changes in the air-fuel ratio. Therefore, when there is no fuel leakage from the fuel chamber 44 to the air chamber 46, this technique causes a long-time continuation of a lean air-fuel ratio state. As a result, the exhaust emissions from the engine 20 deteriorate.

In general, after gas is purged from the air chamber 46 to the intake passage 50, the vapor concentration correction factor FGPG shifts to a value near "0" since there is normally no fuel leakage from the fuel chamber 44 to the air chamber 46. Therefore, if the vapor concentration correction factor FGPG is forcibly reset to a value near "0" as indicated by the solid line in FIG. 8B at the elapse of a predetermined response delay time (a time point t2 in FIGS. 8A to 8D) after the supply of the drive signal to the bypass VSV 90 is started, the amount of fuel supplied to the engine 20 rapidly changes to an appropriate amount provided that there is no fuel leakage from the fuel chamber 44 to the air chamber 46. Therefore, this technique makes it possible to avoid an event that at the time of start of the fuel leakage detection, the air-fuel ratio is on the lean side, as indicated by the solid line in FIG. 8C.

After a time point t3 when the supply of the drive signal to the bypass VSV 90 is stopped in order to end the fuel leakage detection, the vapor concentration correction factor FGPG changes to a value corresponding to the vapor concentration in the gas from the canister 78, with a predetermined response time delay. When there is no fuel leakage from the fuel chamber 44 to the air chamber 46, the vapor concentration in the air chamber 46 is low whereas the vapor concentration in the gas from the canister 78 is normally high. Therefore, when under this condition, the supply of the drive signal to the bypass VSV 90 is stopped, the amount of fuel supplied to the engine 20 increases, so that the air-fuel ratio shifts to the rich side. If in this case, the vapor concentration correction factor FGPG is corrected toward a value corresponding to the vapor concentration in the gas from the canister 78 in accordance with changes in the air-fuel ratio as in the case of the lean-side air-fuel ratio state, in order to resolve the rich-side air-fuel ratio state, then the rich-side air-fuel ratio state continues for a long time, so that exhaust emissions from the engine 20 deteriorate.

When purge from the canister 78 to the intake passage 50 is resumed, the vapor concentration correction factor FGPG shifts toward a value that is substantially equal to the value assumed during the previous operation. Therefore, if at the elapse of a predetermined response delay time (at a time point t4 in FIGS. 8A to 8D) after the stop of the supply of the drive signal to the bypass VSV 90, the vapor concentration correction factor FGPG is returned to the value assumed immediately before the fuel leakage detection, the amount of fuel supplied to the engine 20 rapidly changes to an appropriate amount. Therefore, this technique makes it possible to avoid an event that at the end of the fuel leakage detection, the air-fuel ratio is on the rich side.

Therefore, the fuel storage apparatus of this embodiment forcibly resets the vapor concentration correction factor FGPG to a value near "0" when starting the fuel leakage detection, and returns the vapor concentration correction factor FGPG to the value assumed immediately before the start of the fuel leakage detection. The system of this embodiment is realized by the ECU 10 executing a routine as illustrated in FIG. 9 in the fuel storage apparatus as shown in FIG. 1, instead of the routine shown in FIG. 4.

Figure 9:
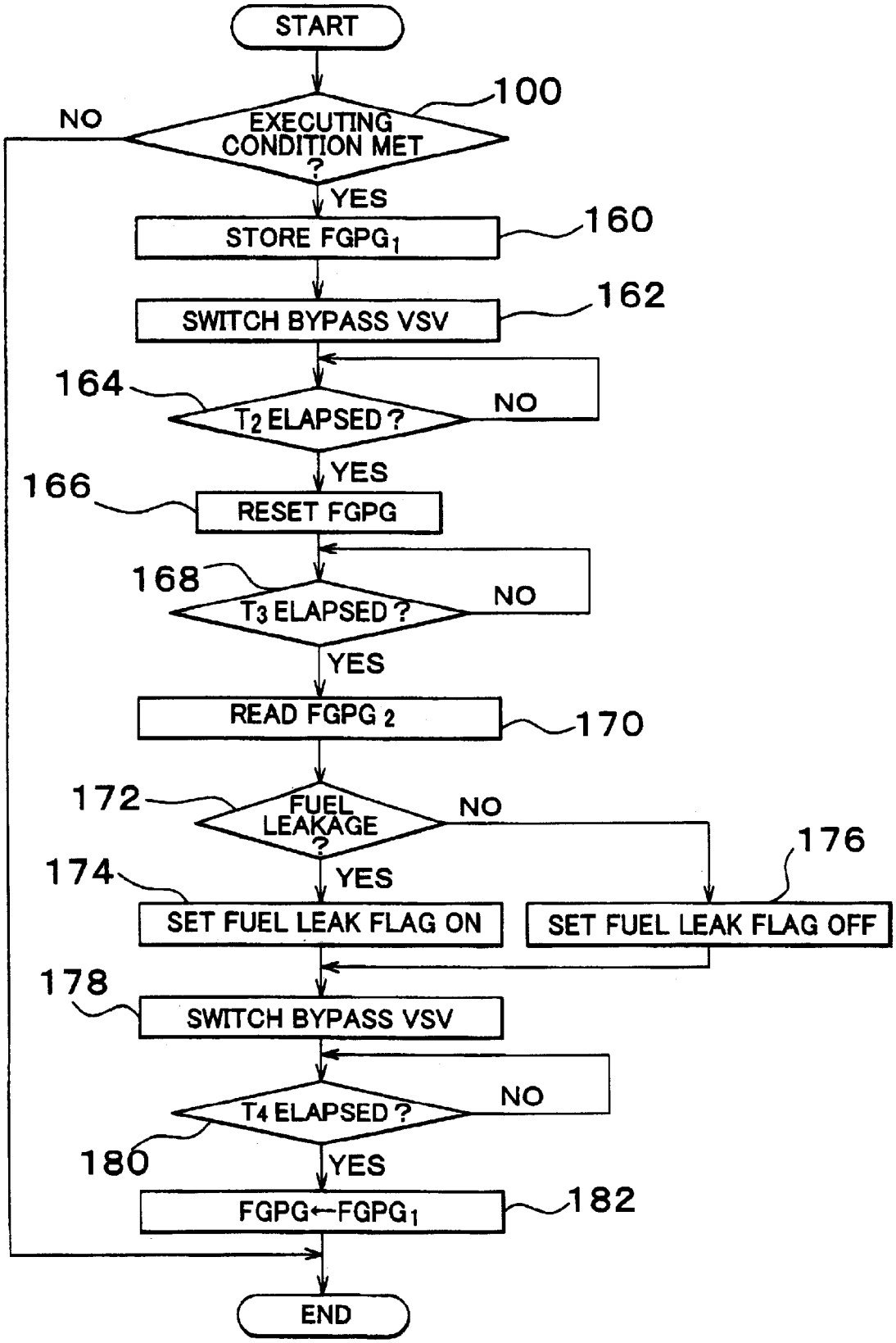
FIG. 9 is a flowchart exemplifying a control routine executed in order to perform fuel leakage detection in the fuel storage apparatus of the embodiment.

FIG. 9 is a flowchart exemplifying a control routine executed by the ECU 10 in order to determine whether there is fuel leakage from the fuel chamber 44 to the air chamber 46. The routine shown in FIG. 9 is repeatedly started every time the processing of the routine ends. Steps in FIG. 9 of executing the same processes as those of steps shown in FIG. 4 are represented by the same reference numerals, and will be merely briefly described or will not be described below.

In the routine shown in FIG. 9, after the fuel leakage detection executing condition is met in step 100, the ECU 10 subsequently executes a process of step 160.

In step 160, the ECU 10 executes a process of storing the vapor concentration correction factor FGPG provided when the fuel leakage detection executing condition is met, as FGPG1. In this case, the vapor concentration correction factor FGPG assumes a value corresponding to the vapor concentration of the purge gas purged from the canister 78 toward the intake passage 50.

Subsequently in step 162, the ECU 10 executes a process of supplying the drive signal to the bypass VSV 90. Due to execution of the step 108, the surge tank 82 becomes and will remain directly connected in communication to the air chamber 46, bypassing the canister 78.

Subsequently in step 164, the ECU 10 determines whether a predetermined length of time T2 has elapsed following the supply of the drive signal to the bypass VSV 90 in step 162, that is, following the start of purge of gas from the air chamber 46 to the intake passage 50. The predetermined length of time T2 is a response delay time T11 that is expected to elapse, following the supply of the drive signal to the bypass VSV 90, before the vapor concentration correction factor FGPG reaches a value corresponding to the vapor concentration in, the gas present in the air chamber 46. The predetermined length of time T2 is set to a value empirically determined beforehand. The process of step 162 is repeatedly executed until it is determined that the predetermined length of time T2 has elapsed. When it is determined that the predetermined length of time T2 has elapsed, the ECU 10 subsequently executes a process of step 166.

In step 166, the ECU 10 executes a process of resetting the vapor concentration correction factor FGPG for a decreasing correction of the fuel injection duration TAU, to a predetermined value FGPG0. The predetermined value FGPG0 is a value corresponding to such a low vapor concentration that it can be considered that there is no fuel leakage from the fuel chamber 44 to the air chamber 46 caused by an abnormality in the system. The predetermined value FGPG0 is set to a value empirically determined beforehand. Execution of the process of step 166 increases the duration TAU of fuel injection from the fuel injection valve.

Subsequently in step 168, the ECU 10 determines whether a predetermined length of time T3 has elapsed following the resetting of the vapor concentration correction factor FGPG in step 166. The predetermined length of time T3 is set to a time T12 that is expected to elapse before the accumulation of amounts of purge flow of gas purged from the air chamber 46 toward the intake passage 50 reaches a predetermined value. The process of step 168 is repeatedly executed until it is determined that the predetermined length of time T3 has elapsed. When it is determined that the predetermined length of time T3 has elapsed, the ECU 10 subsequently executes a process of 170.

In step 170, the ECU 10 executes a process of reading or inputting the vapor concentration correction factor FGPG provided at the time of execution of step 170, as FGPG2. In this case, the vapor concentration correction factor FGPG assumes a value corresponding to the vapor concentration in the gas purged directly from the air chamber 46 to the intake passage 50.

Subsequently in step 172, the ECU 10 determines whether there is fuel leakage from the fuel chamber 44 to the air chamber 46. More specifically, the ECU 10 determines whether FGPG2 is smaller than a predetermined threshold CFGPG2. The predetermined threshold CFGPG2 is a minimum value of the vapor concentration correction factor FGPG that allows the determination that there is no fuel leakage from the fuel chamber 44 to the air chamber 46. If it is determined that there is fuel leakage from the fuel chamber 44 to the air chamber 46, the ECU 10 subsequently executes a process of 174. Conversely, if it is determined that there is no fuel leakage from the fuel chamber 44 to the air chamber 46, the ECU 10 subsequently executes a process of 176.

In step 174, the ECU 10 executes a process of setting up a fuel leakage flag FLAG indicating that there is fuel leakage from the fuel chamber 44 to the air chamber 46. When the fuel leakage flag FLAG is set up, an alarm is produced and an alarm lamp is turned on for an occupant in the vehicle so as to inform the occupant of the abnormality of fuel leakage from the fuel chamber 44 to the air chamber 46. It is also possible to activate the alarm or the alarm lamp if the flag is set up at least twice.

In step 176, the ECU 10 executes a process of resetting the fuel leakage flag FLAG. After the process of step 174 or step 176 ends, the ECU 10 subsequently executes a process of step 178.

In step 178, the ECU 10 executes a process of stopping the supply of the drive signal to the bypass VSV 90. Due to execution of the process of step 178, the intake passage 50 and the air chamber 46 become and will remain out of direct communication with each other, and the canister 78 becomes and will remain connected in communication to the surge tank 82.

Subsequently in step 180, the ECU 10 determines whether a predetermined length of time T4 has elapsed following the stop of the supply of the drive signal to the bypass VSV 90 in step 178, that is, following the start of purge of gas from the canister 78 toward the intake passage 50. The predetermined length of time T4 is a response delay time that is expected to elapse, following the stop of the supply of the drive signal to the bypass VSV 90, before the vapor concentration correction factor FGPG reaches a value corresponding to the vapor concentration in the gas that has passed through the canister 78. The predetermined length of time T4 is set to a time equal to the predetermined length of time T2. The process of step 180 is repeatedly executed until it is determined that the predetermined length of time T4 has elapsed. When it is determined that the predetermined length of time T4 has elapsed, the ECU 10 subsequently executes a process of step 182.

In step 182, the ECU 10 executes a process of setting the vapor concentration correction factor to FGPG1 stored in step 160. Due to execution of the process of step 182, the fuel injection duration TAU is returned to a value assumed immediately before the execution of the fuel leakage detection.

According to the above-described processes, the vapor, concentration correction factor FGPG can be forcibly reset to a value corresponding to a low vapor concentration at the time of start of the fuel leakage detection, that is, at the elapse of a predetermined time after the surge tank 82 and the air chamber 46 are directly connected in communication by the bypass VSV 90. When the vapor concentration correction factor FGPG is reset to the value corresponding to a low vapor concentration, the fuel injection duration TAU, of the fuel injection valve of the engine 20 is increased, so that the amount of fuel injected form the fuel injection valve increases. If the state of communication of the surge tank 82 is switched from a state where the surge tank 82 is connected in communication to the canister 78 to a state where the surge tank 82 is connected in communication to the air chamber 46, the amount of fuel purged from the fuel tank 40 toward the intake passage 50 normally decreases since the possibility of fuel leakage from the fuel chamber 44 to the air chamber 46 is low. According to the embodiment, therefore, when there is no fuel leakage from the fuel chamber 44 to the air chamber 46, an appropriate amount of fuel is supplied to the engine 20 at the time of start of the fuel leakage detection, thereby avoiding a remarkable fluctuation in the air-fuel ratio.

Furthermore, according to the above-described processes, at the end of the fuel leakage detection, that is, at the elapse of a predetermined time after the canister 78 is connected in communication to the surge tank 82 by the bypass VSV 90, the vapor concentration correction factor FGPG is set to the value assumed immediately before the start of the fuel leakage detection. In this case, the amount of fuel injected form the fuel injection valve quickly becomes equal to the amount set when the surge tank 82 and the canister 78 were previously in communication. Therefore, according to the embodiment, an appropriate amount of fuel is supplied to the engine 20 at the end of the fuel leakage detection, so that a remarkable fluctuation in the air-fuel ratio can be avoided. Therefore, the fuel storage apparatus of the embodiment is able to control deteriorations of exhaust emissions attributed to remarkable fluctuations in the air-fuel ratio occurring before and after execution of the fuel leakage detection.

In the embodiment, the vapor concentration correction factor FGPG is reset to a value corresponding to a low vapor concentration when the fuel leakage detection starts, as described above. Normally, if there is fuel leakage from the fuel chamber 44 to the air chamber 46, the vapor concentration in the air chamber 46 is high. If the vapor concentration correction factor FGPG is reset to the value corresponding to a low vapor concentration at the start of the fuel leakage detection under a condition that the vapor concentration in the air chamber 46 is high, the amount of fuel injected from the fuel injection valve is increased afterwards, and the amount of fuel purged from the air chamber 46 toward the intake passage 50 increases. In this case, the air-fuel ratio sharply shifts to the rich side, so that the vapor concentration correction factor FGPG is more likely to change than in a case where the vapor concentration correction factor FGPG is not reset to a value corresponding to below vapor concentration. According to the embodiment, therefore, since the vapor concentration correction factor FGPG is reset to the value corresponding to a low vapor concentration, the sensitivity of determination regarding fuel leakage from the fuel chamber 44 to the air chamber 46 can be improved.

In the above-described embodiment, the vapor concentration correction factor FGPG is always reset to a value corresponding to a low vapor concentration after the surge tank 82 and the air chamber 46 are directly connected in communication by the bypass VSV 90. However, it is also possible to reset the vapor concentration correction factor FGPG to a value corresponding to a low vapor concentration only when the vapor concentration correction factor FGPG is relatively great to the negative side, that is, the vapor concentration is relatively high, immediately before the surge tank 82 and the air chamber 46 are directly connected in communication. If the vapor concentration correction factor FGPG is a value near "0" immediately before the surge tank 82 and the air chamber 46 are directly connected in communication, the purging of gas from the air chamber 46 toward the intake passage 50 under a condition that there is no fuel leakage from the fuel chamber 44 to the air chamber 46 will not remarkably fluctuate the air-fuel ratio. Therefore, if the vapor concentration correction factor FGPG is a value near "0" immediately before the surge tank 82 and the air chamber 46 are directly connected in communication, it becomes unnecessary to reset the vapor concentration correction factor FGPG when the fuel leakage detection starts.

A fourth embodiment of the invention will be described with reference to FIG. 10 together with FIGS. 2 and 9.

In the above-described third embodiment, the vapor concentration correction factor FGPG is always reset to a value corresponding to a low vapor concentration at the time of start of the fuel leakage detection.

If the air-fuel ratio does not shift to the lean side after purge of gas from the air chamber 46 to the intake passage 50, it can be considered that the vapor concentration in the air chamber 46 has become high. If under this condition, the vapor concentration correction factor FGPG is reset to a value corresponding to a low vapor concentration, the air-fuel ratio shifts to the rich side afterwards, so that the vapor concentration correction factor FGPG shifts to a great value to the negative side again. Thus, if the vapor concentration correction factor FGPG is reset under a condition that the vapor concentration in the air chamber 46 is high, the air-fuel ratio greatly fluctuates. In contrast, if the vapor concentration correction factor FGPG is not reset but is kept at the current value under the condition that the vapor concentration in the air chamber 46 is high, the amount of fuel supplied to the engine 20 quickly reaches an appropriate amount, so that fluctuations in the air-fuel ratio can be reduced.

Conversely, if the air-fuel ratio shifts to the lean side after purge of gas from the air chamber 46 to the intake passage 50, it can be considered that the vapor concentration in the air chamber 46 has become low. If in this case, the vapor concentration correction factor FGPG is reset to a value corresponding to a low vapor concentration, the amount of fuel supplied to the engine 20 quickly reaches an appropriate amount, so that remarkable fluctuations in the air-fuel ratio can be avoided.

Therefore, the system of this embodiment resets the vapor concentration correction factor FGPG if the air-fuel ratio shifts to the lean side immediately after the fuel leakage detection starts. If the air-fuel ratio does not. shift to the lean side in such an occasion, the system maintains the current value of the vapor concentration correction factor FGPG. The system of this embodiment is realized by the ECU 10 executing a routine as illustrated in FIG. 10 in the fuel storage apparatus shown in FIG. 1, instead of the routine shown in FIG. 9.

Figure 10:
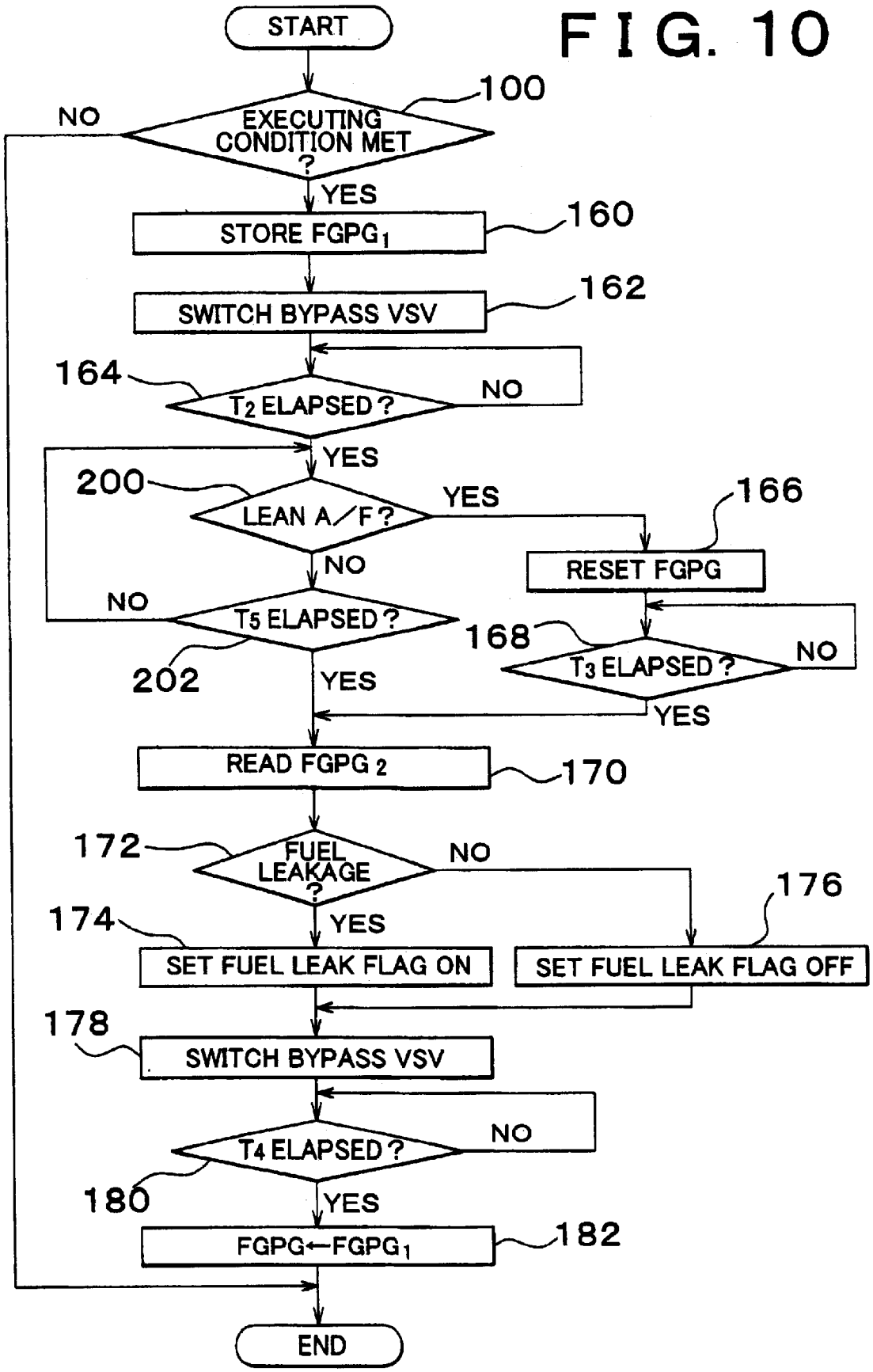
FIG. 10 is a flowchart exemplifying a control routine executed in order to perform fuel leakage detection in a fuel storage apparatus in accordance with a fourth embodiment of the invention.

FIG. 10 is a flowchart exemplifying a control routine executed by the ECU 10 in order to determine whether there is fuel leakage from the fuel chamber 44 to the air chamber 46. The routine shown in FIG. 10 is repeatedly executed every time the processing of the routine ends. Steps in FIG. 10 of executing the same processes as those of steps shown in FIGS. 4 and 9 are represented by the same reference numerals, and will be merely briefly described or will not be described below.

In the routine shown in FIG. 10, if it is determined in step 164 that a predetermined length of time T2 has elapsed following the supply of the drive signal to the bypass VSV 90, the ECU 10 executes processes of step 200 and step 202.

In step 200, the ECU 10 determines whether the air-fuel ratio A/F of the engine 20 is on the lean side based on the output of the $O_2$ sensor 94. If it is determined that the air-fuel ratio A/F is not on the lean side, the ECU 10 subsequently executes a process of step 202.

In step 202, the ECU 10 determines whether a predetermined length of time T5 has elapsed after the negative determination is made in step 200. The predetermined length of time T is set as an air-fuel ratio monitor period. If the predetermined length of time T5 has not elapsed, the process of step 200 is repeatedly executed. When the predetermined length of time T5 has elapsed, the ECU 10 skips steps 166 and 16B, and executes a process of step 170.

If it is determined in step 200 that the air-fuel ratio is on the lean side, the ECU 10 subsequently executes a process of resetting the vapor concentration correction factor FGPG in step 166.

According to the above-described processes, if the air-fuel ratio is on the lean side after the supply of the drive signal to the bypass VSV 90, that is, after purge of gas from the air chamber 46 toward the intake passage 50, the vapor concentration correction factor FGPG is reset to a value corresponding to a low vapor concentration. If the air-fuel ratio is not on the lean side in such an occasion, the vapor concentration correction factor FGPG is kept at the current value. Therefore, the fuel storage apparatus of this embodiment is able to avoid remarkable fluctuations in the air-fuel ratio at the time of start of the fuel leakage detection, and thereby controlling deteriorations of exhaust emissions.

Although in the third and fourth embodiments, the determination regarding fuel leakage from the fuel chamber 44 to the air chamber 46 is performed based on the value FGPG2, it is also possible to determine whether there is fuel leakage from the fuel chamber 44 to the air chamber 46 based on whether the degree of richness of air-fuel ratio occurring after the switching of the bypass VSV 90 is great. In this case, it becomes possible to reduce the time needed to determine whether there is fuel leakage from the fuel chamber 44 to the air chamber 46, because of the principle of calculation of the vapor concentration correction factor FGPG.

Furthermore, although in the third and fourth embodiments, the vapor concentration correction factor FGPG is reset to the predetermined value FGPG0 at the time of execution of the fuel leakage detection, the predetermined value FGPG0 may be changed in accordance with the vapor concentration correction factor FGPG (FGPG1) provided immediately before the surge tank 82 and the air chamber 46 are directly connected in communication. If FGPG1 becomes greater to the negative side, that is, if the amount of fuel adsorbed in the canister 78 becomes greater, there is a higher possibility that the amount of fuel flowing from the fuel chamber 44 to the air chamber 46 of the fuel tank 40, due to permeation through the bladder diaphragm 42 or the like. Therefore, if the value to which the vapor concentration correction factor FGPG is reset is increased to the negative side with increases in FGPG1 to the negative side, fluctuations in the air-fuel ratio can be reduced even in a case where the vapor concentration in the air chamber 46 is high due to fuel permeation or the like.

A fifth embodiment of the invention will next be described with reference to FIGS. 11 and 12 together with FIG. 2.

Figure 11:
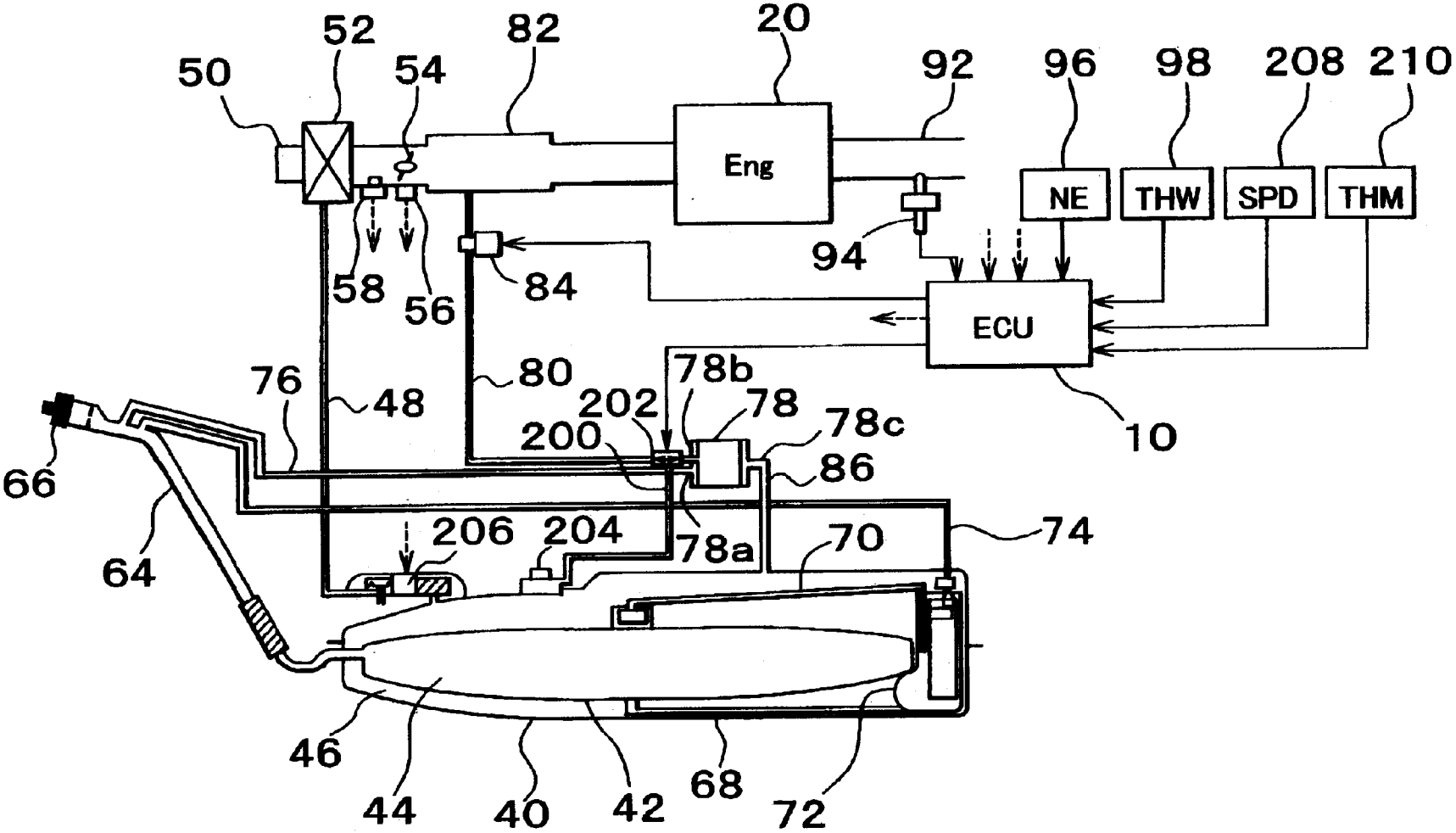
FIG. 11 is a diagram of a system construction of a fuel storage apparatus in accordance with a fifth embodiment of the invention.

FIG. 11 is a diagram illustrating a system construction of a fuel storage apparatus of this embodiment. Component portions in FIG. 11 substantially the same as those shown in FIG. 2 are represented by the same reference numerals, and will not be described below.

As shown in FIG. 11, a bypass passage 200 is connected to both a purge passage 80 and an air chamber 46. That is, the purge passage 80 and the air chamber 46 are directly interconnected by a canister 78 and a gas passage 86, and by the bypass passage 200 bypassing the canister 78. The bypass passage 200 has an inside diameter that is smaller than an inside diameter of the gas passage 86, and has a capacity that is considerably smaller than a capacity of a fuel tank 40.

An electromagnetically driven bypass VSV 202 is disposed in a connecting portion of the bypass passage 200 to the purge passage 80. The bypass VSV 202 is a change valve that changes between a state of connecting an intake passage 50 and the canister 78 in communication and a state of connecting the intake passage 50 and the air chamber 46 in communication, that is, changes a communication passage connecting the intake passage 50 and the air chamber 46, between a passage via the gas passage 86 and a passage via the bypass passage 200. The bypass VSV 202 is a two-position electromagnetic valve that is normally held so as to select the communication passage via the gas passage 86 and, upon supply of a drive signal from an ECU 10, is operated so as to select the communication passage via the bypass passage 200.

A pressure sensor 204 is disposed in the bypass passage 200. The pressure sensor 204 is connected to the ECU 10, and outputs to the ECU 10 an electric signal corresponding to the pressure in the bypass passage 200. Based on the output signal of the pressure sensor 204, the ECU 10 detects the pressure in the bypass passage 200.

A CCV 206 is disposed in an air chamber 46-side end portion of an introduction passage 48. Similar to the above-described CCV 60, the CCV 206 is a two-position electromagnetic valve that is normally held in an open valve state and, upon supply of a drive signal from the ECU 10, is set to a closed valve state.

A vehicle speed sensor 208 and an outside temperature sensor 210 are connected to the ECU 10. The vehicle speed sensor 208 outputs a pulse signal at a frequency corresponding to the vehicle speed SPD. The outside temperature sensor 210 outputs an electric signal corresponding to the outside air temperature (hereinafter, referred to as "outside temperature") THM. The ECU 10 detects the vehicle speed SPD based on the output signal of the vehicle speed sensor 208, and detects an outside temperature THM based on the output signal of the outside temperature sensor 210.

In the above-described first embodiment, after purge of gas from the air chamber 46 to the intake passage 50 is started upon the supply of the drive signal to the bypass VSV 90, the vapor concentration correction factor FGPG provided at the elapse of a time that is expected to elapse, following the elapse of the response delay time of the vapor concentration correction factor FGPG, before the accumulation of amounts of flow of purge flow of gas reaches at least a predetermined value, is used as a vapor concentration in the air chamber 46 for the fuel leakage detection. That is, the fuel leakage detection is performed based on the vapor concentration correction factor FGPG provided after a certain amount of gas has been discharged from the air chamber 46 toward the intake passage 50 following the start of purge of gas from the air chamber 46 toward the intake passage 50.

The temperature of the fuel tank 40 becomes more likely to rise as the outside temperature THM rises. Furthermore, as the vehicle speed SPD decreases the traveling wind upon the fuel tank 40 becomes weaker, so that the temperature of the fuel tank 40 becomes more likely to rise. Therefore, with increases in the outside temperature THM and with increases in the vehicle speed SPD, fuel vapor becomes more likely to be formed in the fuel chamber 44. Furthermore, the amount of fuel evaporating from the fuel chamber 44 increases with increases in the duration during which the vehicle is stopped (hereinafter, vehicle stop duration), and with increases in the duration during which purge from the air chamber 46 to the intake passage 50 is stopped (hereinafter, referred to as "purge stop duration"). In this respect, the amount of fuel flowing from the fuel chamber 44 to the air chamber 46 due to a factor other than fuel leakage caused by an abnormality in the system, for example, fuel permeation through the bladder diaphragm 42, saturation of the canister 78, etc., fluctuates in accordance with the condition of the fuel tank 40, the running condition of the vehicle, etc.

If under this condition, the threshold of the accumulation of amounts of purge flow after the start of purge of gas from the fuel tank 40 to the intake passage 50 is kept at a constant value, the air chamber 46 may, in some cases, contain an amount of fuel attributed to permeation through the bladder diaphragm 42 and the like even after the accumulation of amounts of purge flow reaches the threshold. If in such a case, the vapor concentration correction factor FGPG at that time point is used as a basis for performing the fuel leakage detection, there is danger of a false determination that there is fuel leakage when no fuel leakage is actually caused by an abnormality in the system, such as a membrane hole in the bladder diaphragm 42 or the like.

In order to prevent such a false determination, it is appropriate to reliably evacuate gas from the air chamber 46 by increasing the threshold of the accumulation of amounts of purge flow after the start of purge of gas from the air chamber 46 to the intake passage 50, with increases in the amount of fuel caused to flow from the fuel chamber 44 into the air chamber 46 by permeation through the bladder diaphragm 42 or saturation of the canister 78. If there is only a small amount of fuel caused to flow from the air chamber 46 to the intake passage 50 by permeation through the bladder diaphragm 42 or saturation of the canister 78, it is appropriate to reduce the threshold of the accumulation of amounts of purge flow following the start of purge of gas from the air chamber 46 to the intake passage 50. That is, by changing the threshold of the accumulation of amounts of purge flow following the start of purge of gas from the air chamber 46 to the intake passage 50 in accordance with the condition of the fuel tank 40 or the running condition of the vehicle, it becomes possible to prevent a false determination regarding fuel leakage from the fuel chamber 44 to the air chamber 46 based on the vapor concentration in the air chamber 46, and it becomes possible to accurately determine whether there is fuel leakage.

In the system of this embodiment, therefore, the threshold of the accumulation of amounts of purge flow following the start of purge of gas from the air chamber 46 to the intake passage 50 for the purpose of starting the fuel leakage detection is changed in accordance with the condition of the fuel tank 40 or the running condition of the vehicle. Characteristic portions or elements of the system will be described below.

Figure 12:
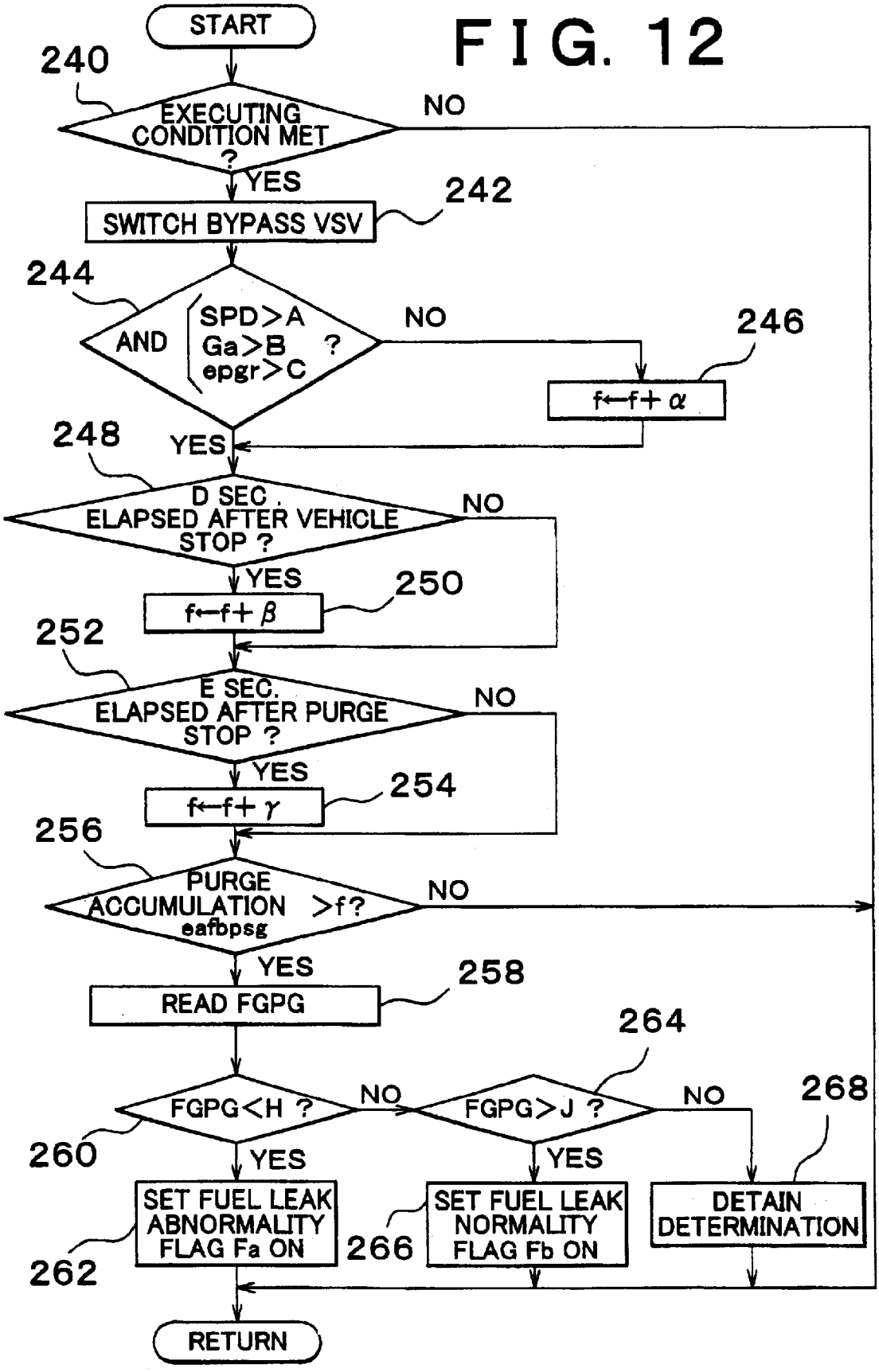
FIG. 12 is a flowchart exemplifying a control routine executed in order to perform fuel leakage detection in the fuel storage apparatus of the embodiment.

FIG. 12 is a flowchart exemplifying a control routine executed by the ECU 10 in order to determine whether there is fuel leakage from the fuel chamber 44 to the air chamber 46 in a fuel storage apparatus of this embodiment. The routine shown in FIG. 12 is repeatedly started every time the processing of the routine ends when the routine shown in FIG. 12 is started, the ECU 10 first executes a process of step 240.

In step 240, the ECU 10 determines whether a fuel leakage detection executing condition is met. This executing condition is met when under a condition that the fuel leakage detection has not been executed following the start of the engine 20, the purge VSV 84 has been opened to purge fuel adsorbed in the canister 78 toward the intake passage 50 and the accumulation of amounts of purge flow has reached a predetermined value. If it is determined that the executing condition is not met, the ECU 10 ends the present execution of the routine without executing any further process. Conversely, if it is determined that the executing condition is met, the ECU 10 subsequently executes a process of 242.

In step 242, the ECU 10 executes a process of supplying the drive signal to the bypass VSV 202. Due to execution of the process of step 242, the intake passage 50 and the air chamber 46 become and will remain connected in communication via bypass passage 200 bypassing the canister 78.

In step 244, the ECU 10 determines (1) whether the vehicle speed SPD is higher than a predetermined value A, (2) whether the amount of intake air Ga is greater than a predetermined value B, and (3) whether the purge rate is higher than a predetermined value C. If it is determined that at least one of the conditions (1) to (3) is not met, the ECU 10 subsequently executes a process of step 246. Conversely, if it is determined that all the conditions (1) to (3) are met, the ECU 10 skips step 246 to execute a process of step 248.

In step 246, the ECU 10 executes a process of increasing a threshold f provided for the purpose of starting the fuel leakage detection, by a predetermined amount α. The threshold f is a threshold of the accumulation of amounts of purge flow following the start of purge of gas from the air chamber 46 to the intake passage 50 upon the supply of the drive signal to. the bypass VSV 202 for the purpose of starting the determination regarding the presence/absence of fuel leakage from the fuel chamber 44 to the air chamber 46. The initial value of the threshold f is set to a summed value obtained by adding an accumulation of amounts of purge flow that is expected to be attained, following the supply of the drive signal to the bypass VSV 90, before gas from the air chamber 46 reaches the $O_2$ sensor 94 and the vapor concentration correction factor FGPG becomes equal to a value corresponding to the vapor concentration in the gas in the air chamber 46 which is detected when the gas reaches the $O_2$ sensor 94, to an accumulation of amounts of purge flow that is expected to be attained before a predetermined amount of gas is discharged from the air chamber 46.

In step 248, the ECU 10 determines whether a predetermined length of time D has elapsed following a stop of the vehicle. If the vehicle stop duration becomes long, the amount of fuel evaporating from the fuel chamber 44 becomes great, so that it can be considered that the amount of fuel flowing into the air chamber 46, permeating through the bladder diaphragm 42, is great. In such a case, it is appropriate to increase the threshold for starting the fuel leakage detection. Therefore, if it is determined in step 248 that the condition is met, the ECU 10 subsequently executes a process of step 250. Conversely, if it is determined that the condition is not met, the,ECU 10 skips step 250 to execute a process of step 252.

In step 250, the ECU 10 executes a process of increasing the threshold f for starting the fuel leakage detection by a predetermined amount β. The process of step 250 is executed at every elapse of a fixed length of time after the elapse, of the predetermined length of time D following the stop of the vehicle. That is, the threshold f for starting the fuel leakage detection is increased at every elapse of the fixed length of time after the elapse of the predetermined length of time D following the stop of the vehicle.

In step 252, the ECU 10 determines whether a predetermined length of time E has elapsed following a stop of purge of gas from the air chamber 46 to the intake passage 50. If the purge stop duration becomes long, the amount of fuel evaporating from the fuel chamber 44 becomes great, so that it can be considered that the amount of fuel flowing into the air chamber 46, permeating through the bladder diaphragm 42, is great, as in the case where the vehicle stop duration becomes long. Therefore, if it is determined in step 252 that the condition is met, the ECU 10 subsequently executes a process of step 254. Conversely, if it is determined that the condition is not met, the ECU 10 skips step 254 to execute a process of step 256.

In step 254, the ECU 10 executes a process of increasing the threshold f for starting the fuel leakage detection by a predetermined amount γ. The process of step 254 is executed at every elapse of a fixed length of time after the elapse of the predetermined length of time E following the stop of the purge. That is, the threshold f for starting the fuel leakage detection is, increased at every elapse of the fixed length of time after the elapse of the predetermined length of time E following the stop of the purge.

In step 256, the ECU 10 determines whether the accumulation of amounts of purge flow following the start of purge of gas from the air chamber 46 to the intake passage 50 upon the supply of the drive signal to the bypass VSV 202 is greater than the threshold f for starting the fuel leakage detection. If this condition is not met, it is considered that the fuel leakage detection should not be started, and the ECU 10 ends the present execution of the routine. Conversely, if the condition is met, the ECU 10 subsequently executes a process of step 258 in order to start the fuel leakage detection.

In step 258, the ECU 10 executes a process of reading or inputting the vapor concentration correction factor FGPG. provided at the time of execution of the process of step 258.

Subsequently in step 260, the ECU 10 determines whether the vapor concentration correction factor FGPG read in step 258 is smaller than an abnormality determination threshold H. The vapor concentration correction factor FGPG assumes a value to the negative side when a large amount of fuel is contained in the purge gas purged from the side of the fuel tank 40 to the intake passage 50. When not much fuel is contained in the purge gas, the vapor concentration correction factor FGPG assumes a value near "0". The abnormality determination threshold H is set to a lower limit value of the vapor concentration correction factor FGPG that does not allow the determination that there is fuel leakage.

If it is determined that FGPG<H holds, it can be considered that the purge gas contains a large amount of fuel and therefore that the vapor concentration in the air chamber 46 is high. In this case, it can be considered that there is fuel leakage from the fuel chamber 44 to the air chamber 46. Therefore, if it is determined that FGPG<H holds, the ECU 10 subsequently executes a process of step 262.

In step 262, the ECU 10 executes a process of turning on a fuel leakage abnormality flag Fa indicating that there is fuel leakage from the fuel chamber 44 to the air chamber 46. When the fuel leakage abnormality flag Fa is set up, an alarm is produced and an alarm lamp is turned on for an occupant in the vehicle so as to inform the occupant of the abnormality of fuel leakage from the fuel chamber 44 to the air chamber 46. It is also possible to activate the alarm or the alarm lamp if the fuel leakage abnormality flag Fa is set up successively at least twice. After the process of step 262 ends, the ECU 10 ends the present execution of the routine.

If it is determined in step 260 that FGPG<H does not hold, it is considered that there is no abnormality based on fuel leakage from the fuel chamber 44 to the air chamber 46, and the ECU 10 subsequently executes a process of step 264.

In step 264, the ECU 10 determines whether the vapor concentration correction factor FGPG read in step 258 is greater than a normality determination threshold J. The normality determination threshold J is set to an upper limit value of the vapor concentration correction factor FGPG that allows the determination that there is no fuel leakage and the determination that the system normally functions. If FGPG>J holds, it can be considered that the purge gas does not contain much fuel and that the vapor concentration in the air chamber 46 is low. In this case, it can be considered that there is no fuel leakage from the fuel chamber 44 to the air chamber 46. If it is determined that FGPG>J holds, the ECU 10 subsequently executes a process of step 266. Conversely, if it is determined that FGPG>J does not hold, it cannot be considered that there is fuel leakage from the fuel chamber 44 to the air chamber 46 or that there is no fuel leakage from the fuel chamber 44 to the air chamber 46, and the ECU 10 subsequently executes a process of step 268.

In step 266, the ECU 10 executes a process of turning of a fuel leakage normality flag Fb indicating that there is no fuel leakage from the fuel chamber 44 to the air chamber 46. After the process of step 266 ends, the ECU 10 ends the present execution of the routine.

In step 268, the ECU 10 executes a process of detaining the fuel leakage detection. After the process of step 268 ends, the ECU 10 ends the present execution of the routine.

According to the above-described processes, if the vehicle speed SPD is low, it is possible to change, to an increase side, the threshold for starting the fuel leakage detection, more specifically, the threshold of the accumulation of amounts of purge flow following the start of purge of gas from the air chamber 46 to the intake passage 50. When the vehicle speed SPD becomes low, the traveling wind that the fuel tank 40 receives becomes weaker, thereby establishing a condition where the temperature of fuel tank 40 is likely to rise. In that case, therefore, fuel permeation through the bladder diaphragm 42, saturation of the canister 78 or the like is accelerated, so that the vapor concentration in the air chamber 46 becomes high.

Furthermore, according to the above-described processes, it is possible to change, to the increase side, the threshold of the accumulation of purge for starting the fuel leakage detection in accordance with the vehicle stop duration or the purge stop duration. As the vehicle stop duration or the purge stop duration increases, the amount of fuel caused to flow from the fuel chamber 44 to the air chamber 46 by permeation through the bladder diaphragm 42, saturation of the canister 78, etc. increases.

In this respect, this embodiment changes the threshold for starting the fuel leakage detection in a condition where the temperature of the fuel tank 40 is likely to rise. Therefore, even if the vapor concentration in the air chamber 46 is increased by a factor other than the abnormality in the system, it is possible to prevent a false determination regarding the presence/absence of fuel leakage from the fuel chamber 44 to the air chamber 46. Hence, the system of this embodiment is able to accurately determine whether there is fuel leakage from the fuel chamber 44 to the air chamber 46, even if a situation where the temperature of the fuel tank 40 is likely to rise is established.

Although in the above-described fifth embodiment, the amounts of increasing correction $\alpha$, $\beta$, $\gamma$ used to change the threshold of the accumulation of amounts of purge flow for starting the fuel leakage detection are fixed values, the amounts of increasing correction may also be changed in accordance with the outside air temperature. More specifically, if the outside air temperature is high, fuel vapor is likely to be formed in the fuel chamber 44 and the vapor concentration in the air chamber 46 becomes high due to permeation through the bladder diaphragm 42 and the like, so that it is appropriate to increase the aforementioned amounts of correction.

Furthermore, although in the fifth embodiment, the threshold for starting the fuel leakage detection, that is, the threshold of the accumulation of amounts of purge flow following the start of purge of gas from the air chamber 46 to the intake passage 50, is changed in accordance with the condition of the fuel tank 40 or the running condition of the vehicle, it is also possible to keep the threshold at a fixed value and accumulate amounts of purge flow following the start of purge of gas from the air chamber 46 to the intake passage 50 in accordance with the condition of the fuel tank 40 or the like. For example, the accumulated amount is counted if the vehicle speed is high. If the vehicle speed is low, the counting of the accumulated amount is prohibited. Based on the vapor concentration in the air chamber 46 detected when the accumulated amount reaches a predetermined threshold, it is determined whether there is fuel leakage.

Still further, in the fifth embodiment, the increase of the threshold for the fuel leakage detection is restricted provided that (1) the vehicle speed SPD is greater than the predetermined value A, (2) the amount of intake air Ga is greater than the predetermined value B, and (3) the purger ate is greater than the predetermined value C. However, it is also possible to restrict the increase of the threshold for the fuel leakage detection if any one of the conditions (1) to (3) is met.

Furthermore, in the fifth embodiment, the threshold for the fuel leakage detection is increased with increases in the vehicle stop duration or the purge stop duration. However, the threshold for the fuel leakage detection may be increased by the greater one of the amounts of increasing correction $\beta$, $\gamma$ provided that the vehicle stop duration is long and that the purge stop duration is long.

A sixth embodiment of the invention will be described with reference to FIGS. 13 and 14.

In the above-described embodiment, the threshold for starting the fuel leakage detection, that is, the threshold of the accumulation of amounts of purge flow following the start of purge of gas from the air chamber 46 to the intake passage 50, is changed in accordance with the condition of the fuel tank 40 or the running condition of the vehicle.

In contrast, in the sixth embodiment, the threshold of the vapor concentration correction factor FGPG for the fuel leakage detection is changed in accordance with the outside temperature THM. This construction makes it possible to prevent a false determination regarding the presence/absence of fuel leakage from the fuel chamber 44 to the air chamber 46 attributed to an abnormality in the system even if the vapor concentration in the air chamber 46 is increased due to a high outside air temperature.

FIG. 13 is flowchart exemplifying a control routine executed by the ECU 10 in order to determine whether there is fuel leakage from the fuel chamber 44 to the air chamber 46 in a fuel storage apparatus of this embodiment. The routine shown in FIG. 13 is repeatedly executed every time the processing of the routine ends. Steps in FIG. 13 of executing the same processes as those of steps in FIG. 12 are represented by the same reference numerals, and will not be described again. In the routine shown in FIG. 13, after an affirmative determination is made in step 256, the ECU 10 subsequently executes a process of step 280.

In step 280, the ECU 10 executes a process of reading or inputting the vapor concentration correction factor FGPG and the outside temperature THM provided at the time of execution of step 280.

Subsequently in step 282, the ECU 10 executes a process of setting an abnormality determination threshold $H_{SH}$ and a normality determination threshold $J_{SH}$ of the vapor concentration correction factor FGPG for the fuel leakage detection to values corresponding to the outside temperature THM read in step 280.

Figure 14:
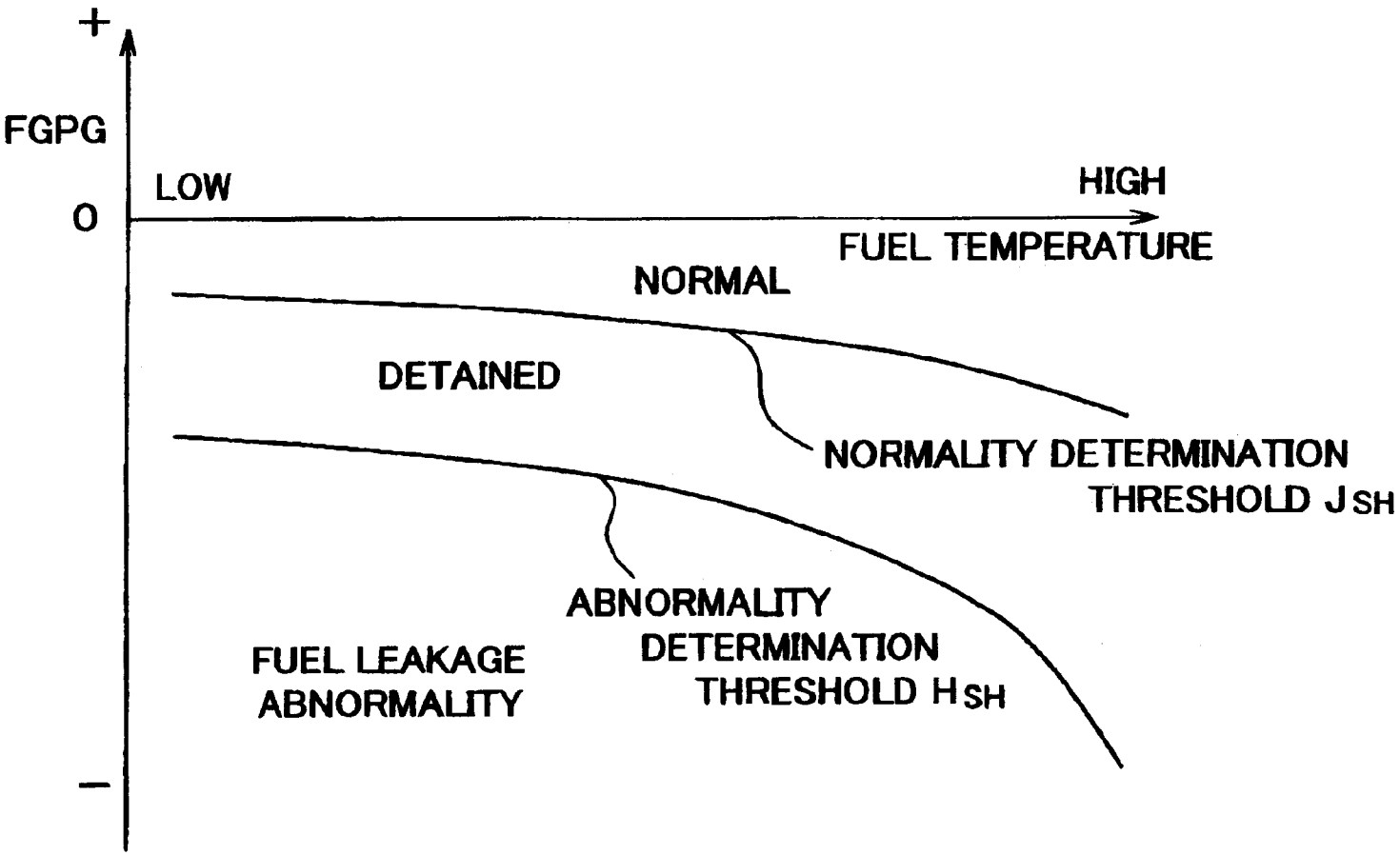
FIG. 14 is a diagram indicating a relationship between the fuel temperature and thresholds of the vapor concentration correction factor FGPG for starting the fuel leakage detection in the embodiment.

FIG. 14 is a diagram indicating a relationship between the fuel temperature and the thresholds of the vapor. concentration correction factor FGPG for the fuel leakage detection. As indicated in FIG. 14, both the abnormality determination threshold $H_{SH}$ and the normality determination threshold $J_{SH}$ of the vapor concentration correction factor FGPG for the fuel leakage detection increase to the negative side as the fuel temperature rises.

In step 282, the ECU 10 sets an abnormality determination threshold $H_{SH}$ and a normality determination threshold $J_{SH}$ of the vapor concentration correction factor FGPG for the fuel leakage detection by referring to FIG 14. After the process of step 282 ends, the ECU 10 subsequently executes a process of step 284.

In step 284, the ECU 16 determines whether the vapor concentration correction factor FGPG read in step 280 is smaller than the abnormality determination threshold $H_{SH}$ set in step 282. If FGPG<$H_{SH}$ holds, it can be considered that the amount of fuel contained in the purge gas is great and that the vapor concentration in the air chamber 46 is high. In this case, it can be considered that there is fuel leakage from the fuel chamber 44 to the air chamber 46. If it is determined that FGPG<$H_{SH}$ holds, the ECU 10 subsequently executes the process of step 262. Conversely, if it is determined that FGPG<$H_{SH}$ does not hold, it is considered that there is no abnormality caused by fuel leakage from the fuel chamber 44 to the air chamber 46 and the ECU 10 subsequently executes a process of step 286.

In step 286, the ECU 10 determines whether the vapor concentration correction factor FGPG read in step 280 is greater than the normality determination threshold $J_{SH}$ set in step 282. If FGPG>$J_{SH}$ holds, it can be considered that the. purge gas does not contain much fuel and that the vapor concentration in the air chamber 46 is low. In this case, it can be considered that there is no fuel leakage from the fuel chamber 44 to the air chamber 46. If it is determined that FGPG>$J_{SH}$ holds, the ECU 10 subsequently executes a process of step 266. Conversely, if it is determined that FGPG>$J_{SH}$ does not hold, it cannot be considered that there is fuel leakage from the fuel chamber 44 to the air chamber 46 or that there is no fuel leakage, and the ECU 10 subsequently executes the process of 268.

According to the above-described processes, the threshold for determining whether there is fuel leakage from the fuel chamber 44 to the air chamber 46 caused by an abnormality in the system can be set to a value corresponding to the outside temperature THM. AS the outside air temperature rises, fuel vapor becomes more likely to be formed in the fuel tank, so that fuel permeation through the bladder diaphragm 42 or the like is accelerated and the vapor concentration in the air chamber 46 increases. In this respect, the embodiment changes the threshold for the fuel leakage detection in accordance with the outside temperature THM, and therefore makes it possible to prevent a false determination regarding the presence/absence of fuel leakage from the fuel chamber 44 to the air chamber 46 even if the vapor concentration in the air chamber 46 is increased due to a high outside temperature THM. Thus, the system of this embodiment is able to accurately determine whether there is fuel leakage from the fuel chamber 44 to the air chamber 46, regardless of the outside air temperature.

Referring next to FIGS. 15 through 18, as well as FIG. 11, a seventh embodiment of the present invention will be now described. In this embodiment, the ECU 10 executes the routines of FIG. 16 and FIG. 17 in place of the routine of FIG. 12 or FIG. 13, in the fuel storage apparatus as shown in FIG. 11.

When fuel is supplied to the fuel chamber 44 of the fuel tank 40 during refueling, a large amount of fuel vapor is generated, and the resulting saturation of the canister 78 may cause a large amount of fuel to flow from the fuel chamber 44 into the air chamber 46. Thus, the vapor concentration in the air chamber 46 is increased immediately after refueling, and there is a possibility of false detection as to the presence of fuel leakage even if no fuel leakage occurs due to an abnormality of the system.

If an abnormality arises in the system, for example, if a hole is present in the bladder diaphragm 42, or a pipe to be coupled to the fuel chamber 44 is disconnected, or a crack is formed in such a pipe, the vapor concentration in the air chamber 46 increases in a short period of time even after gas in the air chamber 46 is discharged into the intake passage 50. If no abnormality arises in the system, and fuel is supplied to the fuel tank 40 by refueling, on the other hand, the vapor concentration in the air chamber 46 does not increase in a short period of time once the gas in the air chamber 46 is discharged into the intake passage 50.

In this embodiment, where refueling of the vehicle takes place, fuel leakage detection is performed after the interior of the air chamber 46 is purged to some extent. In this case, even if the vapor concentration in the air chamber 46 is increased due to refueling, fuel leakage detection is performed based on the vapor concentration measured after the fuel vapor is discharged to the outside of the chamber 46. It is thus possible to prevent a false determination on the fuel leakage, which would be otherwise caused by refueling. The characteristics of this embodiment will be now explained in detail.

Figure 15:
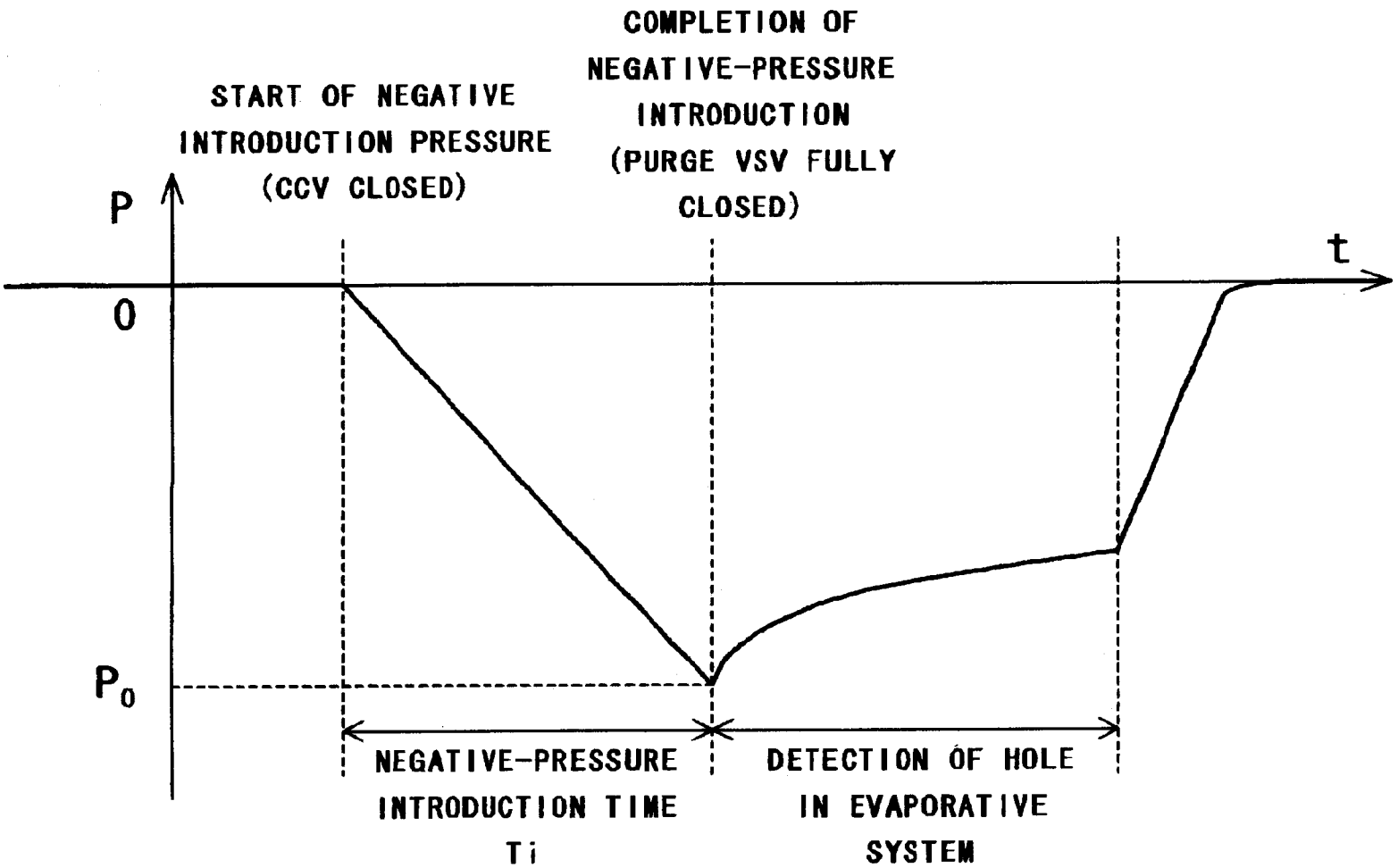
FIG. 15 is a diagram useful for explaining operations performed during detection of a hole in an evaporative system.

FIG. 15 is a diagram useful for explaining the operation performed when determining whether a hole is present in the evaporative system in the present embodiment. In the evaporative purge system of this embodiment, the pressure within the evaporative system, including the fuel tank 40, introduction passage 48 and the purge passage 80, is reduced down to the predetermined negative pressure P0, utilizing a negative pressure of the intake passage 50. Then, the determination on the presence of a hole in the evaporative system is made based on subsequent pressure changes in the evaporative system. Thus, a negative pressure of the intake passage 50 needs to be introduced into the evaporative system, so as to carry out the detection of a hole in the evaporative system according to the present embodiment.

"Negative-pressure introduction time $T_i$" as indicated in FIG. 15 is defined as a period from a point of time when the introduction of the negative pressure starts to a point of time when the pressure reaches the predetermined level P0. The negative-pressure introduction time $T_i$ changes depending upon the volume of the interior of the evaporative system, While the operating state or condition of the engine 20 is kept constant, the vacuum introduction time $T_i$ increases with an increase in the volume of the interior of the evaporative system, and decreases with a reduction in the same volume. In this connection, when fuel is supplied to the fuel chamber 44 of the fuel tank 40, the bladder diaphragm 42 expands in accordance with the amount of the fuel supplied, with the results of an increase in the volume of the fuel chamber 44 in the fuel tank 40 and a reduction in the volume of the air chamber 46. In this case, since the volume of the interior of the evaporative system is reduced as compared with that before refueling, the time period $T_i$ of introducing negative pressure into the evaporative system is reduced. Accordingly, whether fuel has been supplied to the fuel tank 40 or not can be determined by comparing the negative-pressure introduction time $T_i$ with the previous one while the operating state of the engine 20 is kept constant. As described above, the negative-pressure introduction time $T_i$ starts when a negative pressure begins to be introduced into the evaporative system with the CCV 206 closed, and ends when the pressure inside the system reaches the predetermined level P0.

Figure 16:
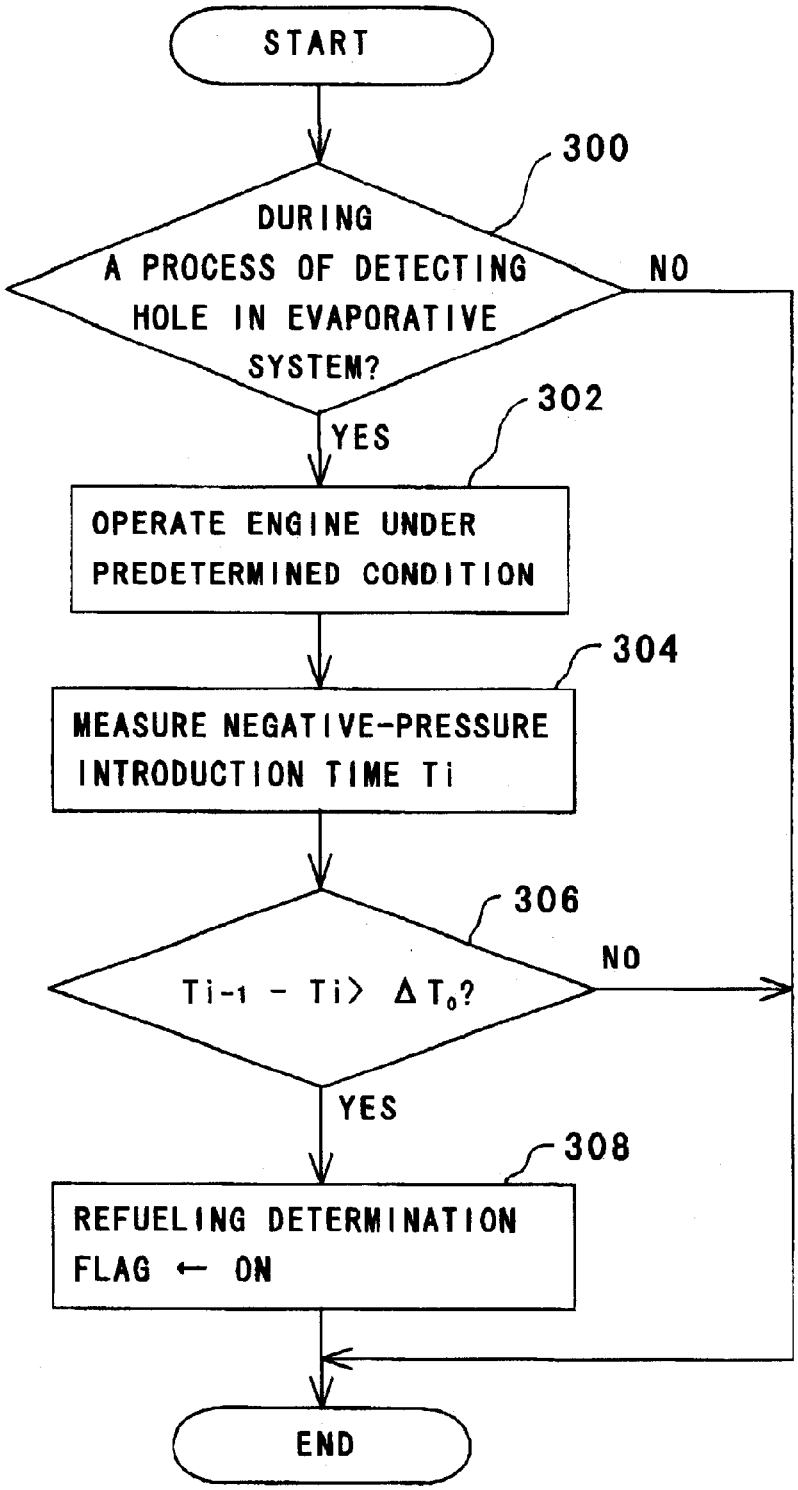
FIG. 16 is a flowchart of one example of a control routine to be executed for determining whether refueling has occurred or not, in a fuel storage apparatus of the seventh embodiment of the invention.

FIG. 16 is a flowchart showing an example of a control routine that is executed by the ECU 10 for determining whether refueling, namely, supply of fuel into the fuel tank 40, has occurred or not. The routine of FIG. 16 is repeatedly started each time the process is finished. Once the routine of FIG. 16 is initiated, step 300 is executed.

In step 300, it is determined whether introduction of a negative pressure into the evaporative system has started or not, in order to enable determination as to whether a hole is present in the evaporative system. If it is determined that no introduction of a negative pressure has started ("NO" is obtained in step 300), no further step is executed, and the current cycle of the routine is finished. If step 300 determines that introduction of a negative pressure has started, the control flow goes to step 302.

In step 302, an operation to keep the operating state of the engine 20 constant, or keep the engine 20 operating under constant conditions, is performed. If the required driving force of the vehicle varies while the operating state of the engine 20 is being kept constant in step 302, the output torque of the electric motor 22 installed in the vehicle is changed, so as to ensure the required driving force.

In step 304, an operation to measure the negative-pressure introduction time $T_i$ is performed. As described above, the negative-pressure introduction time $T_i$ is defined as a period of time from a point at which a negative pressure begins to be introduced into the evaporative system, to a point at which the pressure P within the fuel tank reaches the predetermined negative pressure P0.

Step 306 is then executed to determine whether the negative-pressure introduction time $T_i$ measured in the above step 304 in the current control cycle is, shorter by a predetermined time $\Delta T_0$ (>0) or more than the negative-pressure introduction time $T_{i-1}$ obtained in the last cycle, namely, whether $T_{i-1}-T_i>\Delta T_0$ is established or not. If $T_{i-1}-T_i>\Delta T_0$ is not established ("NO" is obtained in step 306), the negative-pressure introduction time $T_i$ in the current cycle has not changed so much as compared with the negative-pressure introduction time $T_{i-1}$ in the last cycle, and thus the ECU 10 determines that fuel was not supplied to the fuel tank 40 by refueling. Accordingly, the current control routine is finished when a negative decision (NO) is obtained in step 306. If $T_{i-1}-T_i>\Delta T_0$ is established ("YES" is obtained in step 306), the negative-pressure introduction time is shortened, and thus the ECU 10 determines that fuel was supplied to the fuel tank 40. In this case, the control flow goes to step 308.

In step 308, an operation to set a refueling determination flag to "ON" is performed. After execution of step 308, it is assumed in the following steps that fuel was supplied to the fuel tank 40 through refueling. If the operation of step 308 is finished, the current control routine is finished.

With the process as described above, whether fuel was supplied to the fuel tank 40 through refueling is determined, based on a decision as to whether the period of time $T_i$ in which a negative pressure is introduced into the evaporative system for hole detection in the system becomes shorter than the previous one. Thus, in this embodiment, the determination as to whether refueling was conducted or not can be made based on the negative-pressure introduction time $T_i$, through the use of a device (more specifically, pressure sensor 204) needed, for performing hole detection in the evaporative system, without using any dedicated device.

In order to surely purge the air chamber 46 of fuel vapors, the accumulated value of purge flow amounts of gas that should be expelled by purge from the air chamber 46 to the intake passage 50 after refueling but before fuel leakage detection is varied in accordance with the amount of fuel that has flowed from the fuel chamber 44 into the air chamber 46 due to refueling into the fuel tank 40, namely, with the vapor concentration in the air chamber 46 after refueling. It is thus appropriate to increase the accumulated value of purge flow amounts with an increase in the vapor concentration. In this embodiment where fuel was supplied to the fuel tank 40 through refueling, a threshold of the accumulated value of purge flow amounts is changed in accordance with the vapor concentration of gas in the air chamber 46 after refueling.

Figure 17:
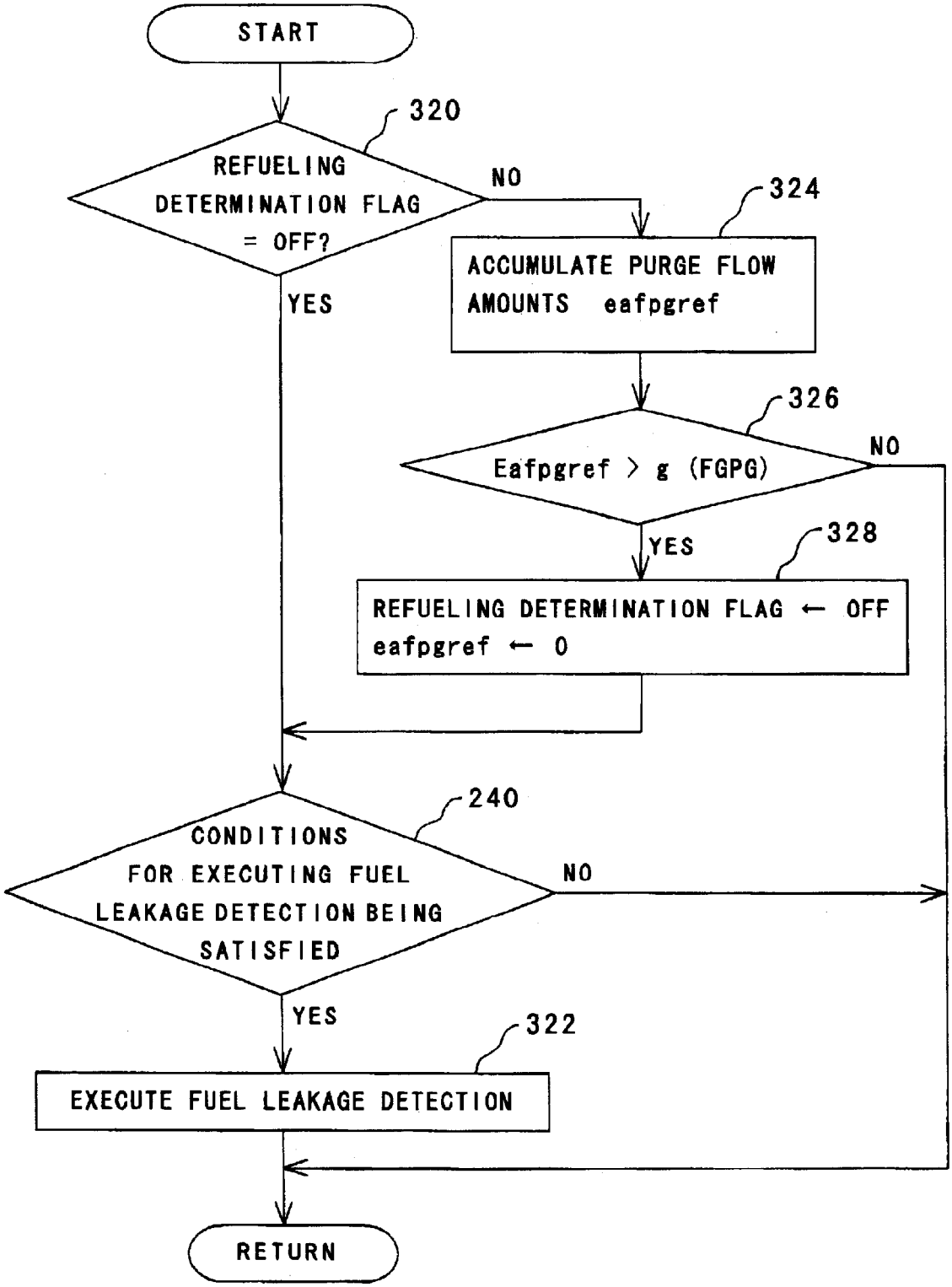
FIG. 17 is a flowchart of one example of a control routine to be executed for effecting fuel leakage detection, in the fuel storage apparatus of the seventh embodiment of the invention.

FIG. 17 is a flowchart showing one example of a control routine to be executed by the ECU 10 for determining the presence/absence of fuel leakage from the fuel chamber 44 into the air chamber 46 in the fuel storage apparatus of this embodiment. The routine as indicated in FIG. 17 is repeatedly started each time its process is finished. Once the routine of FIG. 17 is started, step 320 is initially executed. In FIG. 17, the same step numbers as used in the flowchart of FIG. 12 or FIG. 13 are used for identifying the corresponding steps in which substantially the same operations are performed, and no detailed explanation of these steps will be provided.

In step 320, it is determined whether the refueling determination flag is "OFF" or not, based on the result of execution of the routine as shown in FIG. 16. If step 320 determines that the refueling determination flag is "OFF", namely, refueling into the fuel tank 40 was not conducted, step 240 is then executed to determine whether the conditions for executing fuel leakage detection are satisfied or not. If an affirmative decision (YES) is obtained in step 240, step 322 is executed to perform fuel leakage detection. More specifically, steps 242 through 268 as indicated in FIG. 12, or steps 242 through 268 and steps 280, 282 as indicated in FIG. 13 are executed in step 322 of FIG. 17. When the process of step 322 is finished, the current control routine is terminated.

If step 320 determines that the refueling determination flag is "ON", namely, refueling into the fuel tank 40 was conducted, the control flow goes to step 324.

Step 324 is executed to accumulate the amounts (purge flow amounts) of gas that is discharged by purge from the air chamber 46 to the surge tank 82 through the purge passage 80 after refueling into the fuel tank 40 is determined. The accumulated value of the discharge amounts will be hereinafter denoted as eafpgref.

Step 326 is then executed to determine whether the accumulated value eafpgref of the purge flow amounts thus obtained in the above step 324 has exceeded a predetermined value g or not.

Figure 18:
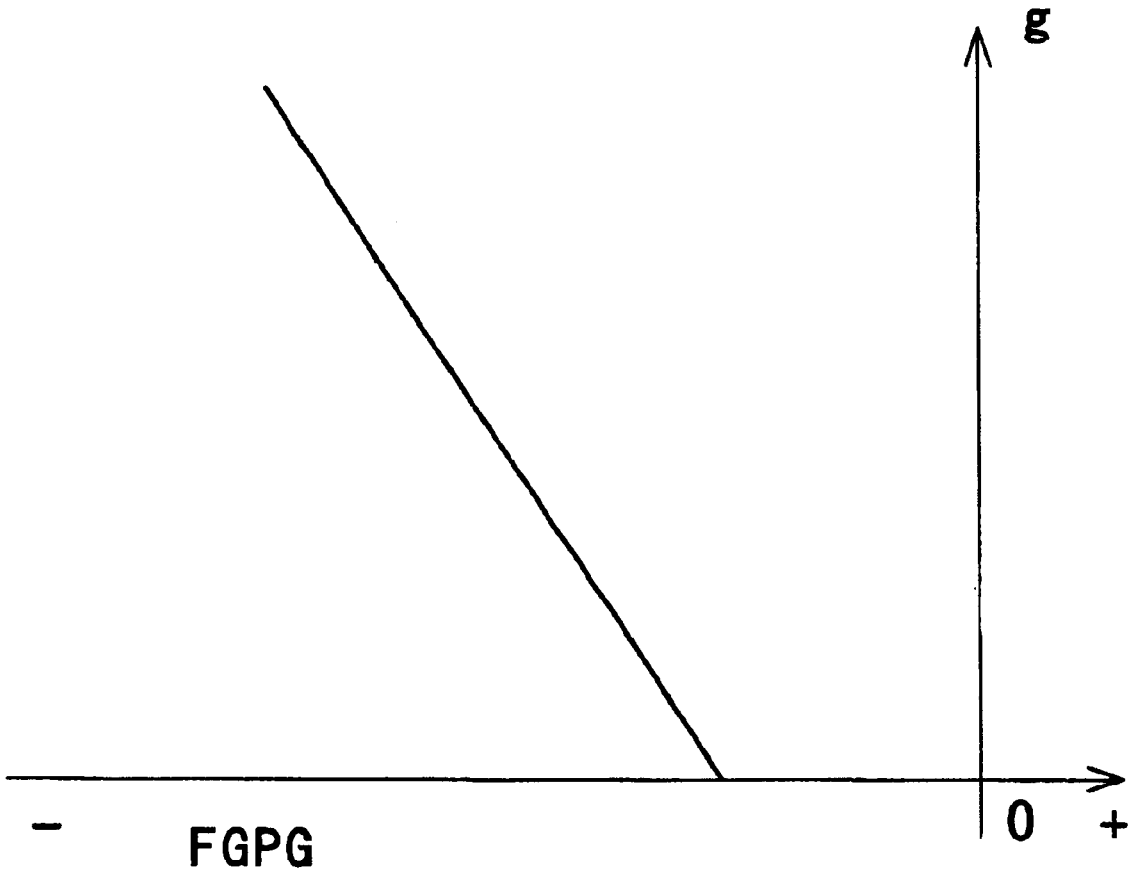
FIG. 18 is a graph showing the relationship between a vapor concentration correction factor FGPG and a predetermined value g in the seventh embodiment.

FIG. 18 is a map indicating the relationship between the vapor concentration correction factor FGPG and the. predetermined value g. As shown in FIG. 18, the predetermined value g is set to a larger value as the vapor concentration correction factor FGPG resulting from refueling becomes a larger negative value, namely, as the vapor concentration within the air chamber 46 is increased. In step 326, the predetermined value g is set with reference to the map shown in FIG. 18.

If step 326 determines that eafpgreg>g (FGPG) is not established ("NO" is obtained in step 326), the ECu 10 can determine that fuel resulting from refueling still remains in the air chamber 46. If "NO" is obtained in step 326, the fuel leakage detection is not performed, and the current routine is finished. If step 326 determines that eafpgreg>g (FGPG) is established ("YES" is obtained in step 326), the ECU 10 can determine that no fuel resulting from refueling remains in the air chamber 46, and the vapor concentration in the air chamber 46 may be used for determining the presence/absence of fuel leakage. Thus, a false determination on fuel leakage due to refueling can be prevented. If "YES" is obtained in step 326, the control flow goes to step 328.

In step 328, the refueling determination flag is set to "OFF", and the accumulated value eafpgref of the purge flow amounts is reset to "0". When the operation of step 328 is finished, step 240 and subsequent steps are then executed.

According to the process as described above, when fuel was supplied to the fuel tank 40 by refueling, fuel leakage detection can be carried out after the air chamber 46 in which the vapor concentration has increased due to refueling is purged of a certain amount of gas. Thus, in this embodiment, the air chamber 46 in which the vapor concentration has increased due to refueling can be purged of fuel vapors before the fuel leakage detection is performed. In the fuel storage apparatus of this embodiment, therefore, the increase in the vapor concentration in the air chamber 46 due to refueling is eliminated at the time of fuel leakage detection, thus preventing a false determination on the presence/absence of fuel leakage from the fuel chamber 44 into the air chamber 46.

Furthermore, according to the process as described above, after refueling into the fuel tank 40 is conducted, a threshold of accumulated value of the purge flow amounts of gas in the air chamber 46 for use in fuel leakage detection can be changed in accordance with the vapor concentration in the air chamber 46. Namely, in this embodiment, the threshold of the accumulated value of the purge flow amounts is made larger as the vapor concentration in the air chamber 46 increases, so that the air chamber 46 in which the vapor concentration has increased because of refueling can be surely purged of fuel vapors prior to fuel leakage detection. With the fuel storage apparatus of this embodiment, it is possible to prevent an error in the fuel leakage detection, which would otherwise occur due to a change in the vapor concentration in the air chamber 46 after refueling into the fuel tank 40.

In the seventh embodiment as described above, the determination as to whether fuel was supplied to the fuel tank 40 by refueling is made based on the negative-pressure introduction time $T_i$ in which a negative pressure is introduced into the evaporative system for effecting hole detection in the system, as shown in FIG. 16. However, the method of determining whether refueling has occurred is not limited to this method, but may be selected from other methods. For example, the determination on refueling may be made using a sensor for detecting attachment or detachment of the fuel cap 66 to or from the fuel tank 40, or a level gauge for measuring the fuel amount in the fuel chamber 44, or may be made based on the magnitude of changes in the tank pressure P during refueling.

While a negative pressure that is produced in the intake passage 50 is introduced into the evaporative system in the seventh embodiment, the present invention is not limited to this arrangement. For example, a negative pressure may be introduced into the evaporative system, using an electric pump, or the like.

In the first to seventh embodiments, the bladder diaphragm 42 corresponds to "partition membrane" described in appended claims of this application. The ECU 10, executing the process of step 116, is a "concentration detecting means" described in appended claims. The ECU 10, executing the processes of steps 126, 172 or steps 260, 264, is a "fuel leakage determining means" described in claims. The ECU 10, executing the process of step 244, 248 or 252, or detecting the outside temperature THM based on the output signal of the outside temperature sensor 210 in step 280, is a concentration increase degree detecting means described in claims. The ECU 10, executing the process of step 166 as shown in FIG. 9, is a "fuel injection increasing means" described in claims. The ECU 10, executing the process of step 306 as shown in FIG. 16, is a "refueling determining means" described in claims. A "negative-pressure introducing means" described in claims may be realized by introducing a negative pressure into the evaporative system, utilizing a negative pressure of the intake passage 50, so as to effect hole detection in the evaporative system. A "predetermined value changing means" described in claims may be realized by changing the predetermined value g according to the vapor concentration correction factor FGPG, using the map of FIG. 18.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements.

What is claimed is:

1. A fuel storage apparatus comprising:

a fuel tank divided into a fuel chamber and an air chamber by a partition membrane;

concentration detecting means for detecting a fuel vapor concentration in the air chamber based on a change in an air-fuel ratio occurring when gas is purged from the air chamber toward an intake passage of an internal combustion engine; and fuel leakage determining means for determining whether there is a fuel leakage from the fuel chamber to the air chamber based on a result of detection by the concentration detecting means, wherein the fuel leakage determining means determines whether there is a fuel leakage from the fuel chamber to the air chamber while a predetermined operational state of the internal combustion engine is maintained.

2. A fuel storage apparatus according to claim 1, further comprising fuel injection increasing means for increasing an amount of fuel injected into the internal combustion engine when purge of gas from the air chamber to the intake passage is started.

3. A fuel storage apparatus according to claim 2, wherein the fuel injection increasing means increases the amount of fuel injected if the air-fuel ratio is on a lean side after the purge of gas from the air chamber to the intake passage is started.

4. A fuel storage apparatus according to claim 2, wherein the fuel injection increasing means increases the amount of fuel injected by reducing an amount of decrease correction of the amount of fuel injected.

5. A fuel storage apparatus comprising:

a fuel tank divided into a fuel chamber and an air a chamber by a partition membrane;

concentration detecting means for detecting a fuel vapor concentration in the air chamber based on a change in an air-fuel ratio occurring when gas is purged from the air chamber toward an intake passage of an internal combustion engine; and fuel leakage determining means for determining whether there is a fuel leakage from the fuel chamber to the air chamber based on a result of detection by the concentration detecting means, wherein when the internal combustion engine is in a transitional state, determination by the fuel leakage determining means as to whether there is a fuel leakage from the fuel chamber to the air chamber is prevented.

6. A fuel storage apparatus according to claim 5, further comprising fuel injection increasing means for increasing an amount of fuel injected into the internal combustion engine when purge of gas from the air chamber to the intake passage is started.

7. A fuel storage apparatus according to claim 6, wherein the fuel injection increasing means increases the amount of fuel injected if the air-fuel ratio is on a lean side after the purge of gas from the air chamber to the intake passage is started.

8. A fuel storage apparatus according to claim 6, wherein the fuel injection increasing means increases the amount of fuel injected by reducing an amount of decrease correction of the amount of fuel injected.

9. A fuel storage apparatus comprising:

a fuel tank divided into a fuel chamber and an air chamber by a partition membrane;

concentration detecting means for detecting a fuel vapor concentration in the air chamber based on a change in an air-fuel ratio occurring when gas is purged from the air chamber toward an intake passage of an internal combustion engine; and fuel leakage determining means for determining whether there is a fuel leakage from the fuel chamber to the air chamber based on a result of detection by the concentration detecting means, wherein the fuel leakage determining means determines whether there is a fuel leakage from the fuel chamber to the air chamber based on the fuel vapor concentration in the air chamber detected by the concentration detecting means after gas is discharged out of the air chamber.

10. A fuel storage apparatus according to claim 9, further comprising:

concentration increase degree detecting means for detecting a degree of increase in the fuel vapor concentration in the air chamber caused by a factor other than the fuel leakage from the fuel chamber to the air chamber, wherein the fuel leakage determining means determines whether there is a fuel leakage from the fuel chamber to the air chamber based on the fuel vapor concentration in the air chamber detected by the concentration detecting means after an amount of time corresponding to the degree of increase detected by the concentration increase degree detecting means elapses following a start of discharge of gas out of the air chamber.

11. A fuel storage apparatus according to claim 10, wherein the concentration increase degree detecting means detects the degree of increase in the fuel vapor concentration in the air chamber caused by a factor other than the fuel leakage from the fuel chamber to the air chamber based on an outside air temperature.

12. A fuel storage apparatus according to claim 9, further comprising:

concentration increase degree detecting means for detecting a degree of increase in the fuel vapor concentration in the air chamber caused by a factor other than the fuel leakage from the fuel chamber to the air chamber, wherein the fuel leakage determining means determines whether there is a fuel leakage from the fuel chamber to the air chamber based on the fuel vapor concentration in the air chamber detected by the concentration detecting means after an amount of gas discharged out of the air chamber after a start of discharge of gas out of the air chamber reaches an amount corresponding to the degree of increase detected by the concentration increase degree detecting means.

13. A fuel storage apparatus according to claim 12, wherein the concentration increase degree detecting means detects the degree of increase in the fuel vapor concentration in the air chamber caused by a factor other than the fuel leakage from the fuel chamber to the air chamber based on an outside air temperature.

14. A fuel storage apparatus according to claim 9, further comprising fuel injection increasing means for increasing an amount of fuel injected into the internal combustion engine when purge of gas from the air chamber to the intake passage is started.

15. A fuel storage apparatus according to claim 14, wherein the fuel injection increasing means increases the amount of fuel injected if the air-fuel ratio is on a lean side after the purge of gas from the air chamber to the intake passage is started.

16. A fuel storage apparatus according to claim 14, wherein the fuel injection increasing means increases the amount of fuel injected by reducing an amount of decrease correction of the amount of fuel injected.

17. A fuel storage apparatus comprising:

a fuel tank divided into a fuel chamber and an air chamber by a partition membrane;

concentration detecting means for detecting a fuel vapor concentration in the air chamber based on a change in an air-fuel ratio occurring when gas is purged from the air chamber toward an intake passage of an internal combustion engine; and fuel leakage determining means for determining whether there is a fuel leakage from the fuel chamber to the air chamber based on a result of detection by the concentration detecting means, wherein the fuel leakage determining means determines whether there is a fuel leakage from the fuel chamber to the air chamber by comparing the fuel vapor concentration in the air chamber detected by the concentration detecting means with a threshold that is changed in accordance an outside air temperature.

18. An abnormality diagnostic method of a fuel storage apparatus, having a fuel tank divided into a fuel chamber and an air chamber by a partition membrane, the method comprising the steps of:

maintaining an internal combustion engine in a predetermined operational state;

detecting a fuel vapor concentration in the air chamber based on a change in an air-fuel ratio occurring when gas is purged from the air chamber toward an intake passage of an internal combustion engine; and determining whether there is a fuel leakage from the fuel chamber to the air chamber based on the detected fuel vapor concentration.

19. An abnormality diagnostic method of a fuel storage apparatus, having a fuel tank divided into a fuel chamber and an air chamber by a partition membrane, the method comprising the steps of:

detecting a fuel vapor concentration in the air chamber based on a change in an air-fuel ratio occurring when gas is purged from the air chamber toward an intake passage of an internal combustion engine;

determining whether there is a fuel leakage from the fuel chamber to the air chamber based on the detected fuel vapor concentration;

determining whether the internal combustion engine is in a transitional state; and preventing the determination of the fuel leakage when the internal combustion engine is in the transitional state.

20. An abnormality diagnostic method of a fuel storage apparatus, having a fuel tank divided into a fuel chamber and an air chamber by a partition membrane, the method comprising the steps of:

detecting a fuel vapor concentration in the air chamber based on a change in an air-fuel ratio occurring when gas is purged from the air chamber toward an intake passage of an internal combustion engine; and determining whether there is a fuel leakage from the fuel chamber to the air chamber based on the detected fuel vapor concentration after gas is discharged out of the air chamber.

21. An abnormality diagnostic method of a fuel storage apparatus, having a fuel tank divided into a fuel chamber and an air chamber by a partition membrane, the method comprising the steps of:

detecting a fuel vapor concentration in the air chamber based on a change in an air-fuel ratio occurring when gas is purged from the air chamber toward an intake passage of an internal combustion engine; and determining whether there is a fuel leakage from the fuel chamber to the air chamber by comparing the fuel vapor concentration with a threshold that is changed in accordance an outside air temperature.

22. A fuel storage apparatus comprising:

a fuel tank divided into a fuel chamber and an air chamber by a partition membrane;

concentration detecting means for detecting a fuel vapor concentration in the air chamber based on a change in an air-fuel ratio occurring when gas is purged from the air chamber toward an intake passage of an internal combustion engine;

fuel leakage determining means for determining whether there is a fuel leakage from the fuel chamber to the air chamber based on a result of detection by the concentration detecting means;

refueling detecting means for detecting whether fuel has been supplied to the fuel tank by refueling; and wherein, when the refueling detecting means determines that the fuel has been supplied to the fuel talk by refueling, the fuel leakage determining means determines whether there is a fuel leakage from the fuel chamber to the air chamber, based on a fuel vapor concentration in the air chamber which is detected by the concentration detecting means after gas in the air chamber is discharged to the outside thereof.

23. A fuel storage apparatus according to claim 22, further comprising negative-pressure introducing means for introducing a negative pressure into the air chamber, and wherein said refueling determining means determines whether fuel has been supplied to the fuel tank by refueling, based on a period of time that ranges from a point of time at which the negative pressure begins to be introduced into the air chamber, to a point of time at which the pressure within the air chamber reaches a predetermined negative pressure.

24. A fuel storage apparatus according to claim 22, wherein, when the refueling detecting means determines that the fuel has been supplied to the fuel tank by refueling, the fuel leakage determining means determines whether there is a fuel leakage from the fuel chamber to the air chamber, based on a fuel vapor concentration in the air chamber which is detected by the concentration detecting means after an accumulated value of discharge amounts of gas in the air chamber to the outside thereof reaches a predetermined value.

25. A fuel storage apparatus according to claim 24, further comprising predetermined value changing means for changing said predetermined value depending upon the fuel vapor concentration in the air chamber that is detected by the concentration detecting means, when the refueling determining means determines that fuel has been supplied to the fuel tank by refueling.

26. A fuel storage apparatus according to claim 24, further comprising fuel injection increasing means for increasing an amount of fuel injected into the internal combustion engine when purge of gas from the air chamber to the intake passage is started.

27. A fuel storage apparatus according to claim 26, wherein the fuel injection increasing means increases the amount of fuel injected if the air-fuel ratio is on a lean side after the purge of gas from the air chamber to the intake passage is started.

28. A fuel storage apparatus according to claim 26, wherein the fuel injection increasing means increases the amount of fuel injected by reducing an amount of decrease correction of the amount of fuel injected.

29. An abnormality diagnostic method of a fuel storage apparatus including a fuel tank divided into a fuel chamber and an air chamber by a partition membrane, the method comprising the steps of:

detecting a fuel vapor concentration in the air chamber based on a change in an air-fuel ratio occurring when gas is purged from the air chamber toward an intake passage of an internal combustion engine;

determining whether refueling has been conducted or not; and determining whether there is a fuel leakage from the fuel chamber to the air chamber, based on a fuel vapor concentration in the air chamber which is detected after gas in the air chamber is discharged to the outside thereof, when it is determined that refueling has been conducted.

* * * * *

UNITED STATES PATENT AND TRADEMARK OFFICE

CERTIFICATE OF CORRECTION

PATENT NO. : 6,446,614 B1
DATED : September 10, 2002
INVENTOR(S) : Takuya Matsuoka et al.

It is certified that error appears in the above-identified patent and that said Letters Patent is hereby corrected as shown below:

Column 9,
Line 40, change “supplied>with” to -- supplied with --.

Column 11,
Line 14, change “VsV” to -- VSV --.
Line 43, change “surge tank 82 50” to -- surge tank 82 --.

Column 13,
Line 17, change “fuel-rice” to -- fuel-rich --.

Column 16,
Line 37, change “=In step 104” to -- In step 104 --.

Column 30,
Line 57, change “a process of 242” to -- step 242 --.

Column 43,
Line 21, change “accordance an” to -- accordance with an --.

Signed and Sealed this

Eighteenth Day of March, 2003

JAMES E. ROGAN
*Director of the United States Patent and Trademark Office*